US007414535B2

(12) United States Patent
Hanabusa et al.

(10) Patent No.: US 7,414,535 B2
(45) Date of Patent: Aug. 19, 2008

(54) ATTACK DETERRENT AND ATTACKER IDENTIFICATION SYSTEM

(76) Inventors: Russell Minoru Hanabusa, 10446 Plum Tree La., Cupertino, CA (US) 95014; Jennie Kao Hanabusa, 10446 Plum Tree La., Cupertino, CA (US) 95014

( * ) Notice: Subject to any disclaimer, the term of this patent is extended or adjusted under 35 U.S.C. 154(b) by 306 days.

(21) Appl. No.: 10/602,506

(22) Filed: Jun. 24, 2003

(65) Prior Publication Data

US 2004/0164866 A1 Aug. 26, 2004

Related U.S. Application Data

(63) Continuation-in-part of application No. 10/263,458, filed on Oct. 2, 2002.

(51) Int. Cl.
*G08B 13/00* (2006.01)

(52) U.S. Cl. ..... 340/574; 600/562; 600/572; 435/6; 436/174; 206/570

(58) Field of Classification Search ..... 340/573.1, 340/574; 600/562–576; 435/6; 436/174, 436/176; 206/570–572
See application file for complete search history.

(56) References Cited

U.S. PATENT DOCUMENTS 3,799,105 A * 3/1974 Porter ..... 116/22 A
4,603,326 A * 7/1986 Freed ..... 340/572.8
4,837,559 A * 6/1989 Green, Sr. ..... 340/573.1
4,873,193 A * 10/1989 Jensen et al. ..... 436/176
4,908,000 A * 3/1990 Counts ..... 446/216
4,917,867 A * 4/1990 Jensen et al. ..... 422/102
5,025,920 A * 6/1991 Walsh et al. ..... 206/223
5,031,287 A * 7/1991 Charlot et al. ..... 24/704.1
5,054,172 A * 10/1991 Hogan et al. ..... 24/704.1
5,186,900 A * 2/1993 Jensen et al. ..... 422/104
5,281,293 A * 1/1994 Frame et al. ..... 156/276
5,455,566 A * 10/1995 Conway ..... 340/573.1
5,477,863 A * 12/1995 Grant ..... 600/572
5,517,180 A * 5/1996 Masi et al. ..... 340/573.1
5,538,170 A * 7/1996 Van Luit ..... 225/47
5,635,917 A * 6/1997 Todman ..... 340/825.37
5,644,296 A * 7/1997 Miller ..... 340/573.1
5,777,553 A * 7/1998 Perreau et al. ..... 340/551
5,780,305 A * 7/1998 Chisum ..... 436/174
6,085,907 A * 7/2000 Hochmeister et al. ..... 206/569
6,602,718 B1 * 8/2003 Augello et al. ..... 436/176

* cited by examiner

*Primary Examiner*—Benjamin C Lee
(74) *Attorney, Agent, or Firm*—Anthony Delas

(57) ABSTRACT

A system for deterring an attack and adding with identification and apprehension of an attacker is disclosed. A vessel containing materials capable of leaving stain, odor, or other markings on the attacker and the victim are employed. Comparison of the materials found on the victim and on the attacker will help establish the connection between the two and aid in the positive identification of the attacker. The system further provides for an audio and light alarm as additional ways for the victim to discourage the attacker. Also included is a tool that will aid the victim in escaping from the attacker's vehicle or other surroundings and a device that will help attract attention to the victim and the attacker. Alternatively, miniature devices are employed that remove samples of the attacker's skin, bone, hair, tissue or bodily fluids and store the same. Subsequent analysis of these samples enables identification of the attacker. Similar devices are also employed to lodge themselves into attacker's skin. These devices contain unique codes that can be employed to identify the attacker. As a further aid in victim rescue and attacker capture, a wireless radio frequency identification device is included, further improving the chances for finding the victim and the attacker.

6 Claims, 21 Drawing Sheets

FIG. 5B
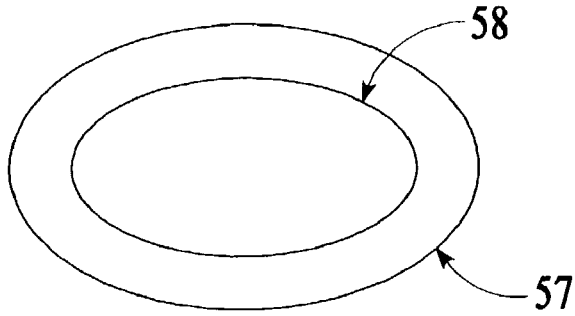
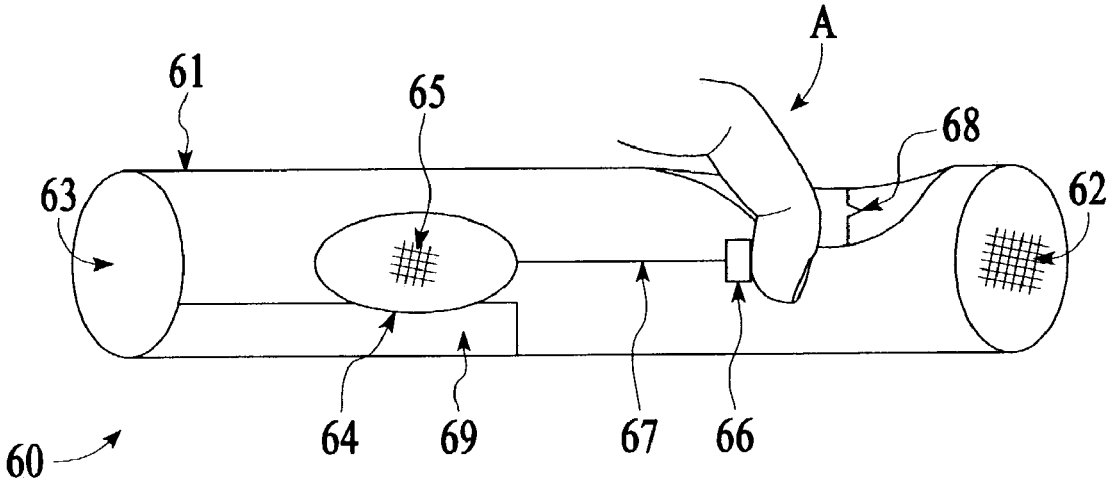
FIG. 6
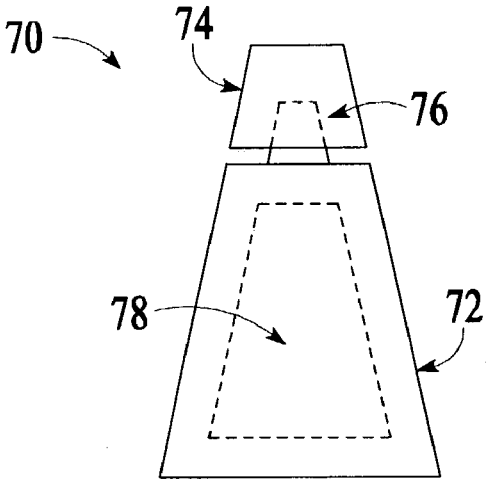
FIG. 7
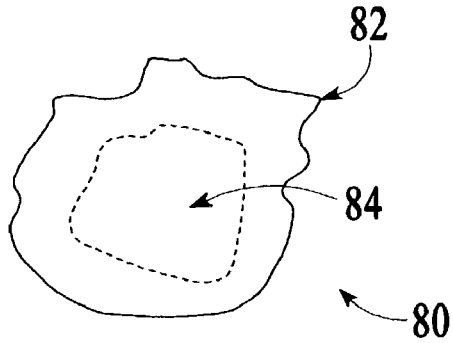
FIG. 8

ATTACK DETERRENT AND ATTACKER IDENTIFICATION SYSTEM

CROSS REFERENCE TO RELATED APPLICATIONS

This application is a Continuation in Part application of the application Ser. No. 10/263,458 filed Oct. 2, 2002, the contents of which are herein incorporated by reference.

BACKGROUND OF THE INVENTION

1. Field of the Invention

The invention relates generally to the area of security systems and more specifically and importantly to protecting individuals from potential and actual attackers and abductors. In particular, the invention is a device that discourages an attacker from assaulting his victim, and, in case he does, the invention will assist with identification and apprehension of the attacker.

The invention is particularly useful in preventing child abduction, assault, rape and similar crimes. According to the Gallup Poll, over 1.3 million children were sexually assaulted in 1995, almost 50% of all rape victims are under age of 18, 29% are 12-17 years of age and 15% are under age of 12. The U.S. Justice Department estimates that nearly ⅔rds of all sex offenders in state prison are there for raping children. The device of this invention could drastically reduce these numbers.

2. Prior Art Situation

Most commonly, one's defense against an attack has included such items as knives, guns and MACE canisters. While guns usually require permits and training, MACE canisters are bulky and need to be carried in a bag and are therefore not within an easy reach of the victim in case of a surprise attack. As a way of overcoming these deficiencies a number of personal security devices have been invented.

U.S. Pat. No. 6,2811,800 discloses a personal security backpack that emits an audio alarm for attracting attention to a crime scene. The unit is stored and concealed in a separate section of the backpack with a power switch installed on the shoulder strap. While this device can serve its intended purpose, an attacker can easily disable the power switch and the victim is left unprotected.

U.S. Pat. No. 4,511,062 utilizes bulky canisters of pressurized gas that need to be carried in a bag or a holster as a way to discourage an attacker. This device requires accurate aiming by the victim at the time the victim may not be in a state of collectedness sufficient to properly operate and aim the device. Moreover, the invention uses tear gas as primary means of defense. While an adult person may be able handle this device safely, a typical child is more likely to cause an injury to itself or others.

U.S. Pat. No. 4,241,850 utilizes a complicated canister with extensive valving arrangement and fluid stored therein. The device careful requires aiming and operation by the user and as such is not very useful in surprise attack situations.

U.S. Pat. No. 4,716,402 describes a complicated combination of personal alarm, a canister chemical spray system, an intrusion detector, a smoke detector and a motion detector. Complicated mechanism and cost are main disadvantages of this system.

U.S. Pat. No. 6,052,051 similarly combines a high power draw incandescent lamp, a control mechanism for remotely activating an alarm system and a pressurized container of a chemical repellent that needs to be carefully aimed to reach the attacker. The size and the cost of this system are its main disadvantages.

U.S. Pat. No. 4,449,474 is a two piece aerosol canister contained in a two piece telescoping housing that releases a gas with offensive odor and generates a shrieking sound upon activation. The device is combined with a key ring. Again, the size, complexity and cost are main disadvantages of this device.

U.S. Pat. No. 4,837,559 combines an audio and video alarm. The device requires a wearer to purposely remove security device from his person and throw it on the ground. This may be difficult to accomplish when confronted by a powerful attacker.

U.S. Pat. No. 5,903,219 also utilizes complex hardware to generate audio and light alarm.

U.S. Pat. No. 5,629,679 combines noxious chemical, audio and light alarms that require careful aiming at the attacker. Again, the complexity and cost of this device are its major disadvantages.

U.S. Pat. No. 5,893,483 likewise requires careful aiming of the device in order to illuminate the assailant with a light beam, energizing a siren and finally spraying the assailant with a deterrent chemical. The complexity, cost and effectiveness of this device are its main disadvantages.

U.S. Pat. No. 3,832,705 describes a device that is limited to an audio alarm and makes no permanent marking on the assailant and is therefore very limited in its usefulness.

U.S. Pat. No. 3,825,833 is likewise and audio alarm that requires pushing, turning or twisting motion to activate the alarm. This limits its usefulness in cases of a surprise attack.

For the reasons stated above there is a need for a personal security device that is effective, easy to use under any circumstances and very cost effective. The invention describe herein meets that requirement.

SUMMARY OF THE INVENTION

The objects and advantages of the invention are achieved by the present invention that comprises a device capable of deterring an attacker and providing an aid in the identification and apprehension process. A simple device, frequently resembling a piece of jewelry and containing materials capable of marking the victim and the attacker is worn by the victim. Once attacked, the victim punctures the device and spreads the identifying materials on himself and the attacker or the device breaks open in the course of the struggle. Comparison of the materials found on the victim and on the attacker will help establish the connection between the two and aid in the positive identification of the attacker. Presence of the identifying materials, some of which have strong odor or leave permanent stain, will likely cause the attacker to change his mind and abandon the victim rather than risk being caught.

Alternatively, in addition to the identifying materials, the device further includes numerous miniature mechanical devices that are capable of collecting tissue, skin, body fluid, bone or hair samples of the attacker and the victim by employing an abrasive surface or a cutting blade. In the course of the struggle the miniature devices are forced between the attacker's and the victim's skin. The pressure exerted upon the miniature devices causes them to cut into the attackers and the victim's tissue. The removed tissue is then stored in storage chamber of the device. The struggle itself combined with the pain from the cutting tools may cause the attacker to cease his aggression. Subsequently, the stored samples are analyzed and provide further aid in identifying the attacker. Moreover, some of the mechanical devices may have a unique identification code that allows for easier identification subsequent to the attack. Another version of this type of device that penetrates the attacker's skin also employees a radio frequency identification device that enables easier identification of the victim and the attacker.

Another approach disclosed includes a device that in addition to the identifying materials comprises an audio source and or a light source. Upon opening the enclosure containing the sources, the materials contained therein are spread as already described. The sources are activated and varying prerecorded calls for help are heard from the audio source. This should discourage the attacker and alert those in the vicinity to come to the victim's aid. Similarly, presence of a light source may also alarm the attacker and cause him to cease his aggression.

To address the post abduction issues a different device has been designed. It comprises a combination of a light source and a cutting tool. The light source would help the victim who is in a dark space, such as a car trunk, see his way towards utilizing the cutting tool to cut through trunk latch device and escape.

A combination of all these aids in the same device is also possible and would substantially improve the victim's chances of escaping the attacker during the attack or afterwards.

OBJECTS AND ADVANTAGES OF THE INVENTION

In view of the above, it is an object of the present invention to provide a device that will deter an attacker and aid in his identification and apprehension.

A further object of the invention is to provide a device that contains materials necessary for the attacker's identification and apprehension.

It is another object of the present invention to enable application of such materials to the attacker's and the victim's persons.

Yet another object of the present invention is to provide a temporary or permanent identifying mark on the attacker's person.

Still a further object of the present invention is to provide a device for collecting samples of the attacker's tissue, skin, body fluids, hair or bone materials that would aid in his identification and apprehension.

It is another object of the present invention to enable the victim to employ an audio source with a help-seeking prerecorded message and contemporaneously apply identifying chemicals to the attacker.

A further object of the present invention is to provide a victim with a light source to aid in deterring the attacker and a tool to aid the victim's escape.

Yet another object of the present invention is to provide a victim with the tissue, skin, body fluid, bone and hair samplers in combination with light source to aid in deterring the attacker and a tool to aid the victim's escape.

Still a further object of the present invention that the device be easy to manufacture and be low in cost.

These and other objects and advantages of the present invention will become more apparent after considering the ensuing description and the accompanying drawings.

BRIEF DESCRIPTION OF THE DRAWINGS

FIG. 6 is puncture actuated tube vessel FIG. 7 is tooth paste tube vessel FIG. 8 is a birthmark, skin like mark, skin rash, human skin, or a scab vessel

DETAILED DESCRIPTION OF THE INVENTION

Figure 1:
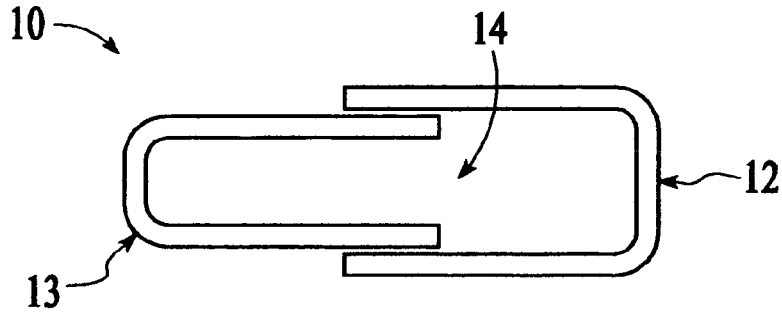
FIG. 1 is a typical capsule vessel

In the most basic embodiment the crime prevention system employees a vessel that houses evidence material to be released from the vessel that is applied or spreads to the attacker and the victim or serve as a vessel leak indicating materials. Spreading of the evidence materials onto the attacker's person may be sufficient to deter him from further aggression. Alternatively, the evidence materials remaining on the attacker and the victim can be analyzed and compared to each other in order to identify the attacker. The following list of evidence materials apply to all of the embodiments of this invention wherever evidence materials are employed, individually or in combination and may be in form of foam, granules, fluid, solid, powder, gas, semi-solid or combination thereof, clear or opaque, odor producing or odorless, and similar or dissimilar materials may be employed in the same application. Similarly, any reference to a vessel means a container manufactured from any natural or man made materials including plastic, metal, steel, ceramic, stone, aluminum, wood, glass, paper, rubber, crystal, foil, fiberglass, absorbent materials, any tissue abrading material, combination of materials, and others, and it may be opaque or translucent, and of shape suitable to contain the evidence material employed and it may come with or without a warning lettering or a warning label on it. If a warning is employed it may come in form of "Stop", Poison, Electrical Hazard or an equivalent symbol, Skull and Bones symbol, a highly reflective surface or -any display that may gain attetnion. Likewise, specific embodiments so identified and discussed herein, may be utilized with or without the evidence material, however the presence of evidence material is preferable as it may serve as a better deterrent and would aid in capture of the attacker.

Evidence materials: particles, foam, granules, solid, liquid, powder, gas, or semi-solid of: commercially available disappearing ink such as thymophthalein and ethanol mixture, iodine, perylene, anthracene, ink, sponge, scouring pad, absorbent materials, foam as produced by dishwashing soap, pine tar, orange chalk powder, bromine gas, aloe, commercially available jelly, mineral oil, odor producing materials: lemon oiled water, coffee oil, coconut oil, pineapple extract, automotive oil, alcohol, base, oil, automotive oil, grease, automotive grease, epoxy, glue, silicon cement, peppermint oil, spearmint oil; particles held under pressure, water, sprit glum, mixture of heterocyclic compound lumino and hydrogen peroxide, an inert material, scouring pad material, lemon oiled water, water with fish-line segments or similar materials: metallic, ceramic, plastic, glass or wood; dishwashing soap, commercially available waterless hand cleaners, steel wool, scotch-brite, fiber optic segments, foam, phosphorus, silicon glue, glitter particles same in size and shape or combination of sizes and shapes, segments of wire, segments of material with unique patterns created therein, string, radioactive material, polonium, sprit glum adhesive, silicon glue, epoxy resin formed by polymerization of bisphenol and epichlorohydrin, deoxyribonucleic acid (DNA), human immunodeficiency virus (HIV), small pocks virus, urushiol, functional semiconductor devices doped with phosphorus and conductors attached thereto, henna, poison oak, metallic mesh wire, plastic mesh, poison ivy, alcohol, base, dry blood or blood encased in a container, bromine gas, water and cesium that burst upon mixing, mercury, cyanide, mix of pentobarbital and sodium pentothal, epoxy resin, epoxy resin formed by polymerization of bisphenol A and epichlorohydrin of varying compositional ratios, perylene that produces fluorescing blue color when exposed to black light, anthracene that produces fluorescing ultra-violet color when exposed to black light, oleoresin capsium (tear gas), and acid.

Light Sources: phosporus, mix of hydrogen peroxide and heterocyclic compound lumino or commercially available light sources such as a light stick, a compound containing 4 grams sodium carbonate, 0.2 grams luminol, 0.5 grams ammonium carbonate and 0.4 grams of copper pentahydrate and 1 liter of water when mixed with 50 milliliters of 3% hydrogen peroxide and 1 liter of water.

All materials may be utilized in form of solid, gas, semi-solid, powder, particles, foam, granules, liquid, gas or whatever form they are most readily available in. A manufacturer of evidence material may alter the formulations so as to insert specific markers that are non-reactive with evidence material and that would aid in capturing the attacker. Similarly, the material also includes manufacturers device registration procedure providing for maintenance of a permanent history of each device manufactured and the traceability to the ultimate purchaser. In case of materials that leave permanent stain the material can be removed only by a remover manufactured by proprietary process under the control of the device manufacturer.

Moreover, to aid in capture, a sample of evidence material identical to the one employed by the victim would be retained by those acquainted with the victim, e.g., in case of a child, the parents would keep the identical vessel at home. Comparing the evidence material found on or in vicinity of the suspect or where the attack took place to that retained by the others would aid in identifying the actual attacker.

FIG. 1 shows a vessel 10 in form of a capsule that has sections 12 and 13 connected together to form the vessel 10 and the evidence material 14 enclosed therein. Separating parts 12 and 13 releases material 14. Evidence material 14 is then applied by the victim to itself and the attacker and can also be spread just in the course of the struggle.

Figure 2:
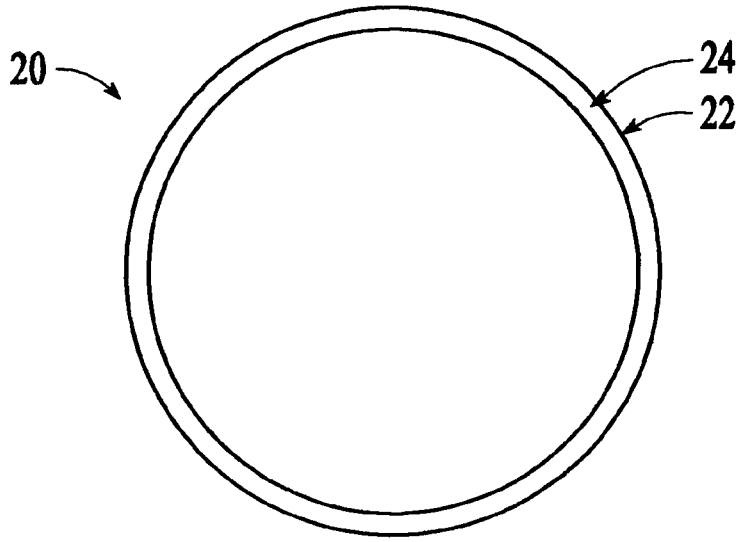
FIG. 2 is a band, ring, wrist band, arm band, toe ring, ankle ring, bracelet vessel

An alternative to the embodiment of FIG. 1 is shown in FIG. 2 where vessel 20 has evidence material 24 held inside band 22. Breaking band 22 releases material 24 that is then spread to the victim and the attacker. Band 22 can be a ring, a wrist band or any object suitable to worn around an arm, finger, wrist, toe, neck of a person, and is typically made of plastic or other easily breakable material.

Figure 2B:
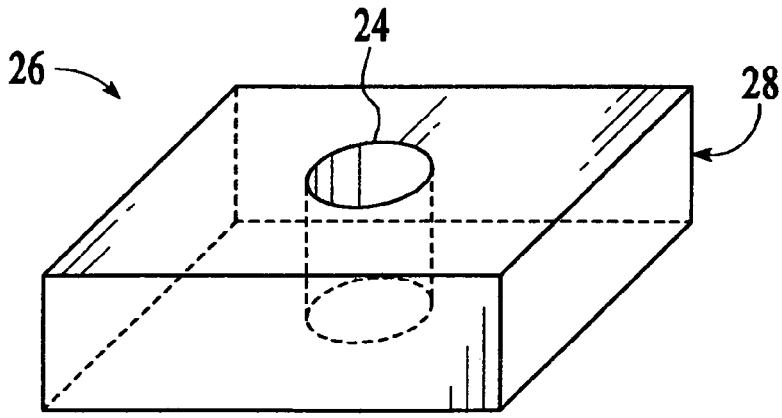
FIG. 2*b* is a soap bar vessel

FIG. 2B shows a vessel 26 that has a enclosure 28 and evidence material 29 housed in enclosure 28. Breaking enclosure 28 releases evidence material 29 that is then spread to the victim and the attacker. Typical enclosure 28 would be a soap bar.

Figure 3:
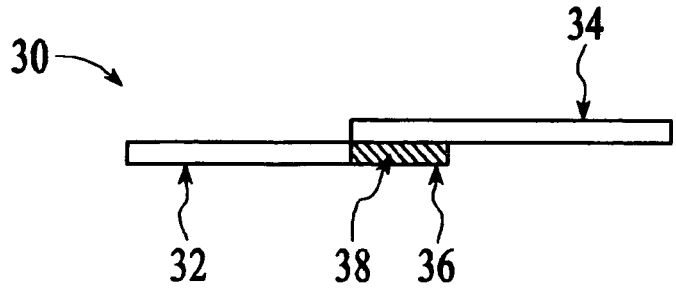
FIG. 3 is a bandage vessel

In FIG. 3, a vessel 30 in form of a bandage includes strips 32 and 34 and central section 36 that is impregnated with evidence material 38. Peeling apart section 34 exposes evidence material 38 that is then spread to the victim to and the attacker.

Figure 4:
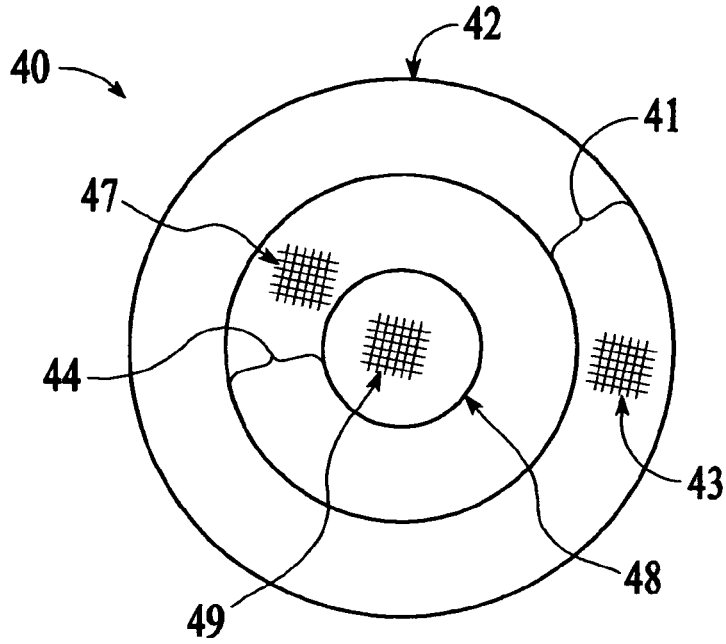
FIG. 4 is a multi chamber vessel

FIG. 4 shows a multi-chamber vessel 40 that has the first enclosure 41 with the outer wall 42, leak indicator material 43 contained in enclosure 41, the second enclosure 44, first evidence material 47 contained in enclosure 44 and the third enclosure 48 containing second evidence material 49. Materials 47 and 49 can be the same or different, one can be a stain causing material and the other can be odor producing material. Leak indicating material 43 allows for inspection of the integrity of evidence enclosure 40 and is typically clear liquid. Alternatively, leak indicating material 43 has fish line segments, fiber-optic cable segments or similar materials dispersed within it for the purpose of being deposited on the attacker and deter the attack and aid with the attacker identification process. Leak indicating material 43 may be in solid, semi solid, fluid, powder, water or gas form, opaque or translucent, colored or colorless. Enclosure 41 can be made of paper, glass, rubber, foil, styrofoam, metal or a combination thereof or of any other suitable materials or combinations thereof. Enclosure 41 can also be of clear plastic polyethylene terepethathalate, low density polyethylene, high density polyethylene, or enclosure 41 can be made somewhat opaque by texturing the outer seal 42 of enclosure 41. Squeezing evidence enclosure 40 causes enclosures 41, 44 and 48 to break and release materials 43, 47 and 49. Outer seal 42 of the enclosure 41 can be stronger than seals of the enclosures 44 and 48. After enclosures 41, 44 and 48 are broken the evidence materials 47 and 49 and leak indicating material 43 are spread to the victim and the attacker and aid in deterring the attack and in subsequent identification of the attacker. In one embodiment of the invention, the enclosure 41 contains evidence material, the enclosure 44 contains water and enclosure 48 is empty.

Figure 5:
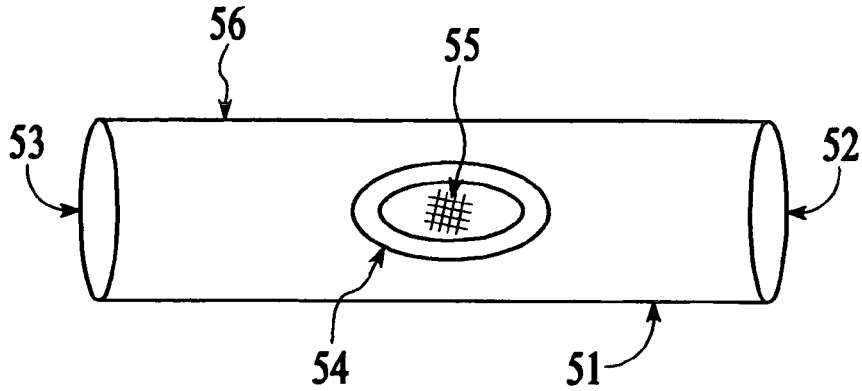
FIG. 5 is pressure actuated tube vessel

FIG. 5 shows vessel 50 that releases its contents after application of pressure. The vessel 50 includes the tube body 51, tube ends 52 and 53, the evidence material holder 54 and evidence material 55. Tube body 51 and evidence material holder 54 are made of any soft material that upon application of force at point 56 will collapse holder 54 and evidence material 55 will flow outwardly, thereby spreading onto the victim and the attacker. Alternatively, holder 54 can be a two chamber unit as shown in FIG. 5B, where 57 is the first chamber and 58 is the second chamber. One chamber can contain water and the other cesium. Applying pressure would break chambers 57 and 58 and the reaction from cesium and water mixture would rapidly propel evidence materials outward.

Another embodiment of vessel is shown in FIG. 6 where 60 is the puncture actuated evidence enclosure that includes the tube body 61, closed end 62, open end 63, evidence material holder 64, evidence material 65, puncture tool 66, puncture point 67, finger insertion section 68 and holder 64 support structure 69. Application of finger A through section 68 at the puncture tool 66 will cause puncture point 67 to penetrate evidence material holder 64 and evidence material 65 will spread outward through end 63 and onto the victim and the attacker. Evidence material holder can be made of any material that is easy to puncture.

FIG. 7 is an embodiment of vessel in form of toothpaste tube 70 that includes tube 72, screw-on neck 76, cap 74 and evidence material 78. Material 78 is squeezed out by removing cap 74 and applying pressure to tube 72 and thereby spreading it onto the victim and the attacker.

A vessel in form of a skin scab, skin mark, birthmark, skin rash or human skin and that can also conceal the evidence material is shown in FIG. 8. Vessel 80 has the outer body 82 and the evidence material holder 84. If vessel 80 is a skin scab, outer body 82 resembles damaged skin or coagulated blood. If vessel 80 is a skin mark, skin rash, human skin, a birthmark, appearance of body 82 would reflect such appearance. A person skilled in art would easily be able to chose the appropriate appearance.

Figure 9:
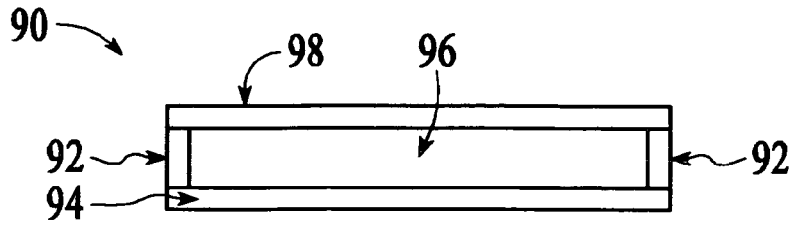
FIG. 9 is cross section of scab vessel
Figure 10:
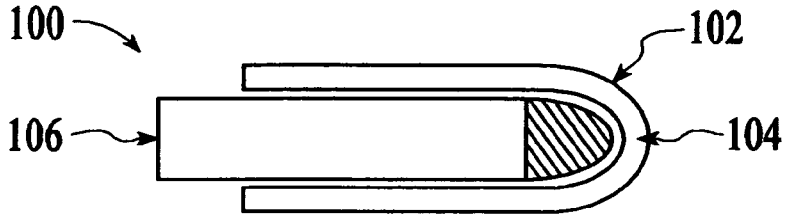
FIG. 10 is a finger-cot vessel

Turning now to FIG. 9, the front view of FIG. 8, the vessel 90 further includes protective layer 94 that protects the wearer from attack by the evidence material involved, side walls 92 and top layer 98. Evidence material 96 is released by removing top layer 98 and material 96 then spreads onto the attacker. Vessel 90 need not include protective layer 94 if evidence materials used are not harmful to human tissue or bone. The protective layer 94 can be re-used by applying adhesive to the side in contact with skin FIG. 10 is a vessel 100 in form of a finger-cot 102 that contains evidence material 104 and slides over finger 106. Applying pressure to finger-cot 102 or removing finger-cot 102 exposes material 104 and causes it to spread onto the people involved. Finger-cot 102 can be made of any easily breakable material.

Figure 11:
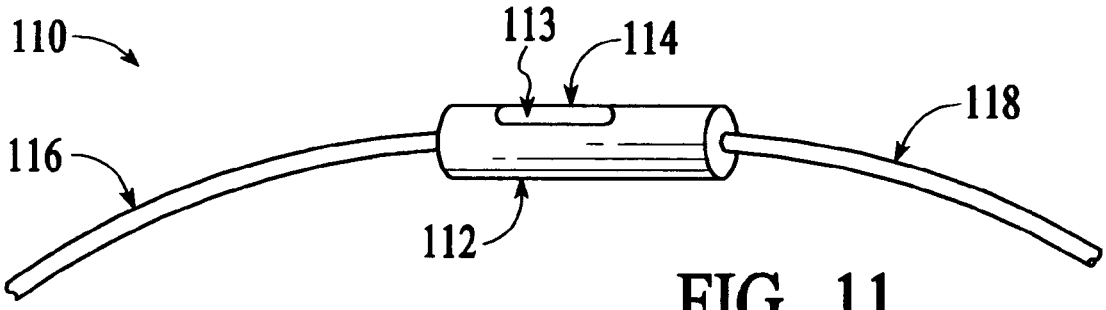
FIG. 11 is cross-section of a watch vessel

A watch type of a vessel is shown in FIG. 11 as watch 110 that has watch body 112, watch bands 116 and 118, evidence material holder 114 and evidence material 113. Evidence material holder 114 is made of soft material to allow for easy release of material 113 upon application of pressure to holder 114. Evidence material 113 is then spread to the victim and the attacker.

Figure 12:
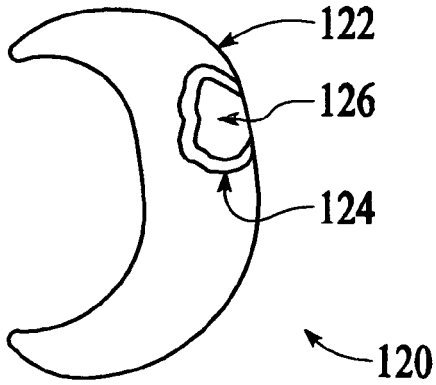
FIG. 12 is side view of an earring vessel

FIG. 12 houses an earring vessel 120 that includes earring body 122, evidence material holder 124 and evidence material 126. Application of pressure on holder 124 releases material 126 and spreads it onto the individuals involved. Holder 124 is made of any easily breakable material.

Figure 13:
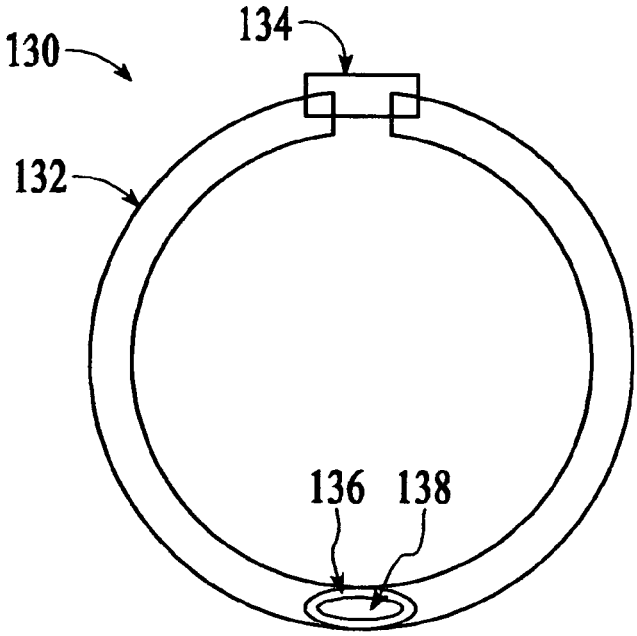
FIG. 13 is front view of necklace vessel

Another embodiment of a vessel is shown in FIG. 13 as necklace 130 that includes necklace body 132, clasp 134, evidence material holder 136 and evidence material 138. Application of pressure on holder 136 releases material 138 and spreads it onto the individuals involved. Holder 136 is made of any easily breakable material.

Figure 14:
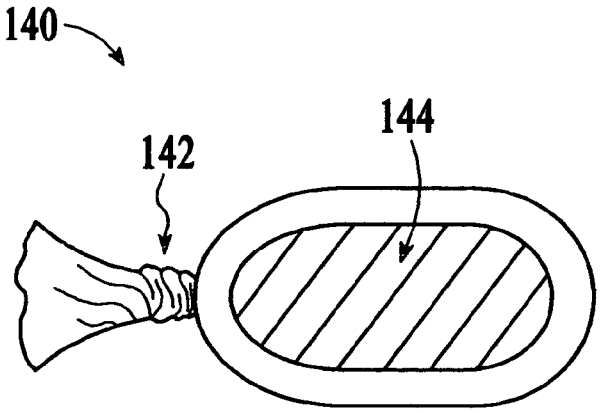
FIG. 14 is front view of wrapper vessel

FIG. 14 shows a wrapper type of a vessel 140 that includes twist off wrapper 142 and evidence material 144 contained therein. Opening wrapper 142 releases material 144 and allows it to be spread onto the victim and the attacker. Similarly, instead of a wrapper, vessel 140 can be a bag, open or re-sealable, made of plastic, paper or similar materials, or vessel 140 may be a bladder.

Figure 15:
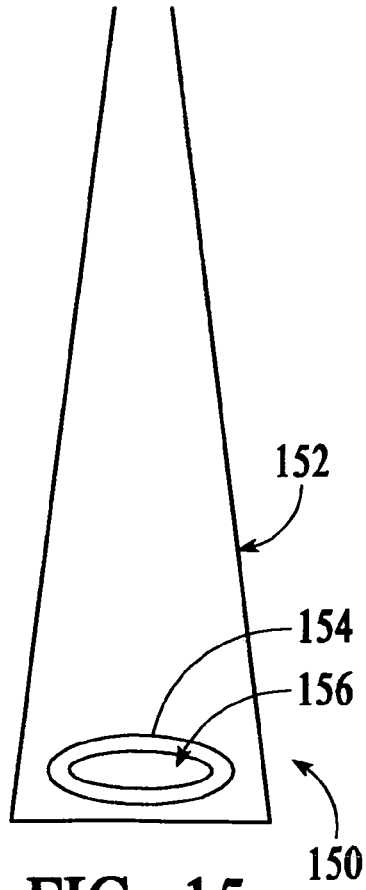
FIG. 15 is front view of tie vessel

In FIG. 15 a vessel is in form of a tie 150 that includes tie body 152, evidence material holder 154 and evidence material 156. Application of pressure on holder 154 releases material 156 and spreads it onto the individuals involved. Holder 154 is made of any easily breakable material.

Figure 16:
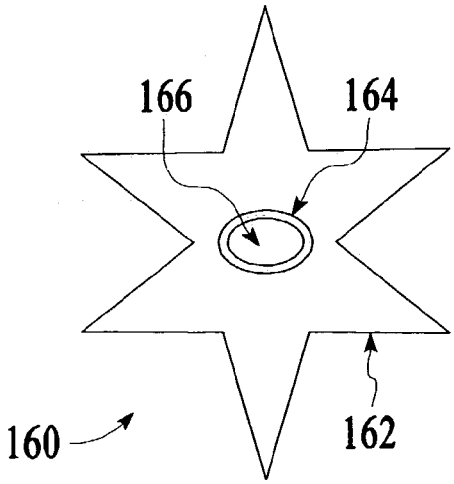
FIG. 16 is front view of badge or a broche vessel

FIG. 16 is a vessel shaped as a badge or a broche wherein the badge or a broche 160 includes body 162 evidence material holder 164 and evidence material 166. Application of pressure on holder 164 releases material 166 and allows it to spread onto the individuals involved. Holder 164 is made of any easily breakable material.

Figure 17:
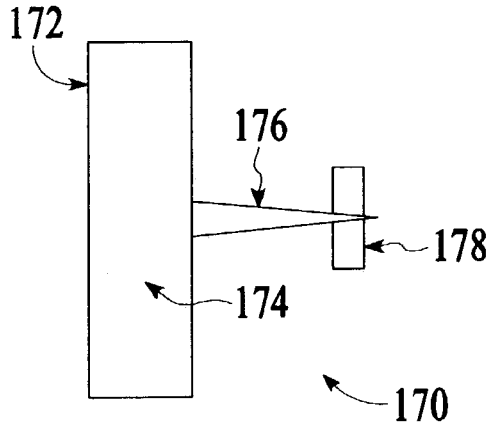
FIG. 17 is cross sectional view of pin vessel

In FIG. 17 a pin 170 is a vessel. Pin 170 has pin body 172, evidence material 174, pin stud 176 and clasp 178. Application of pressure on pin body 172 releases material 174 and allows it to spread onto the individuals involved. Pin body 172 is made of any easily breakable material.

Figure 18:
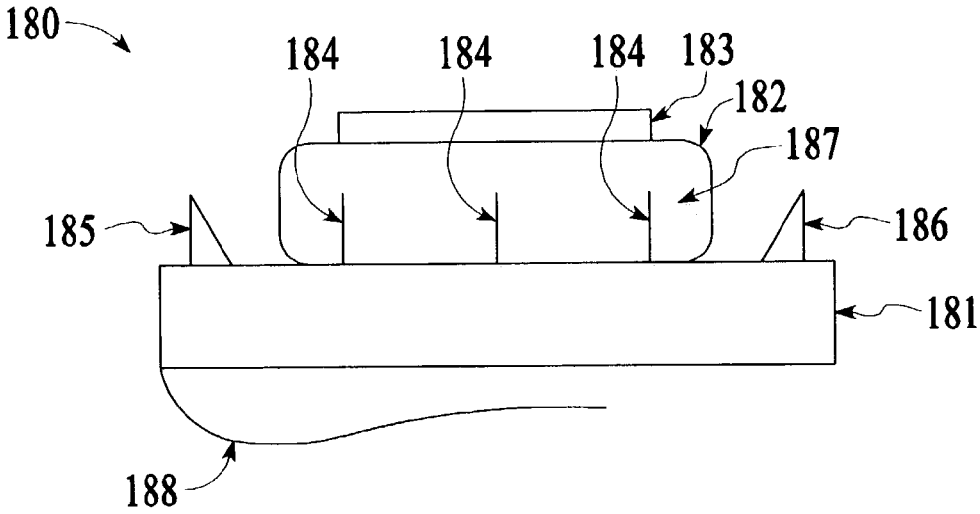
FIG. 18 is a front view of pressure actuated vessel with belt clip

FIG. 18 is front view of pressure actuated vessel where vessel 180 has base 181, evidence material enclosure 182, pressure plate 183, cutting tools 184, 185 and 186 evidence material 187, and an affixing device 188. Upon application of force to pressure plate 183 the evidence enclosure 182 spreads towards cutting tools 184, 185 and 186 that cut open enclosure 182. The cutting action causes instantaneous spread of evidence material 187 to the victim, the attacker and the surroundings. Evidence enclosure 182 may further be air pressurized and would spread evidence material 187 over a wider area. Enclosure 182 is made of any easily breakable material. Affixing device 188 can be a belt clip or any other device capable of attaching vessel 180 to the victim's person.

Figure 19:
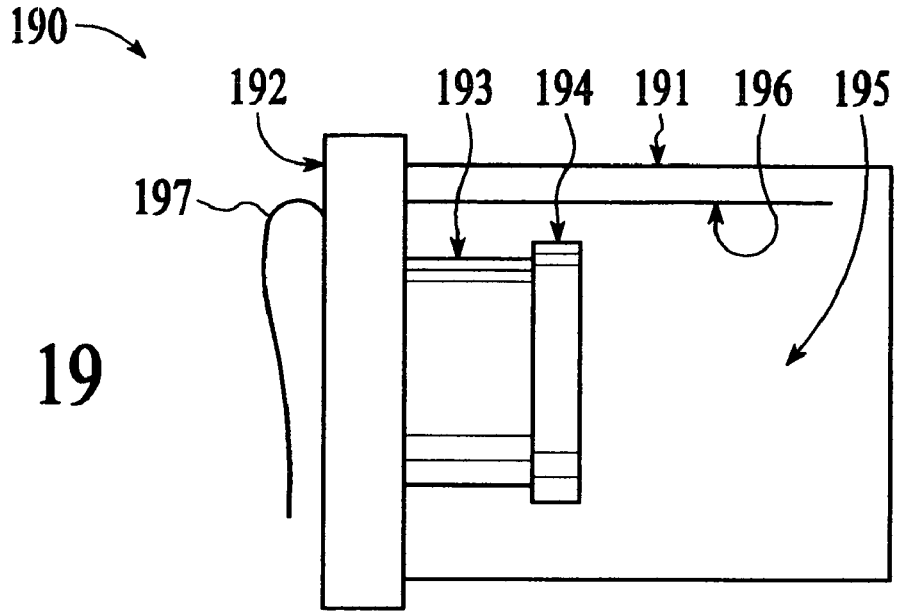
FIG. 19 is a jar vessel housing evidence material and a light generating source

Shown in FIG. 19 is vessel 190 that has a body 191, a lid 192, shock absorbing material 193, light generating source 194, evidence material 195 and an affixing device 197. Shock absorbing material 193 is necessary to prevent premature activation of light source 194. Essentially any material with cushioning action such as a sponge will suffice. Opening lid 192 disturbs light source 194 sufficiently to cause the chemicals contained therein to mix and generate light. Any commercially available light source such as phosporus, mix of hydrogen peroxide and heterocyclic compound lumino or commercially available light sources such as a light stick, a mix containing 4 grams sodium carbonate, 0.2 grams luminol, 0.5 grams ammonium carbonate and 0.4 grams of copper pentahydrate and 1 liter of water when combined with a mix 50 milliliters of 3% hydrogen peroxide and 1 liter of water. If desired, additional pressure can be applied by hand to the light source 194 to assure complete mixing of the chemical. The light source 194 may also be anywhere in the vessel and can be activated by applying pressure to it. Once lid 192 has been removed the victim applies evidence material 195 upon himself and the attacker or material 195 is spread in the course of the struggle. Affixing device 197 can be a belt clip or any other device capable of attaching vessel 190 to the victim's person.

Figure 20:
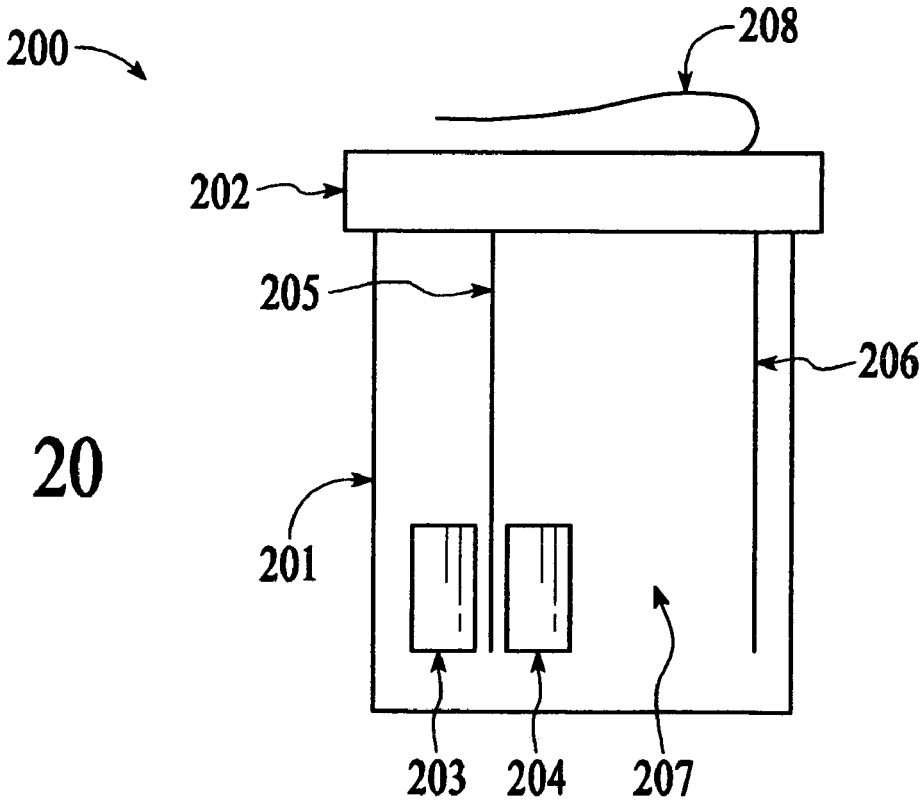
FIG. 20 is a battery or solar operated light source and a cutting tool storage vessel

FIG. 20 is an alternative embodiment of FIG. 19 where vessel 200 includes vessel body 201, lid 202, power source 203, light source 204, insulator tool 205, cutting tool 206, evidence material 207 and an affixing device 208. When lid 202 is separated from vessel body 201 and tool 205 has been pulled away from its position between power source 203 and the light source 204, light source 204 is energized by coming in contact with power source 203. Source 204 may be battery or solar powered light emitting diodes (LED) or lasers. Once lid 202 has been removed the victim spreads evidence material 207 upon himself and the attacker or material 207 spreads by itself in the course of the struggle. Light source 204 serves as a warning to the attacker, or in case of abduction may be used to find one's way out of the attacker's surroundings. Cutting tool 206 is used to help free the victim by cutting through wires, cables, ropes, trunk latches, etc. and can be made of any metallic, ceramic, plastic, glass or other materials of properties sufficient to cut through clothing, ropes or items commonly found in cars, households and similar places. Vessel body 201 is made of any material capable of storing the components described herein. Affixing device 208 can be a belt clip or any other device capable of attaching vessel 200 to the victim's person.

The embodiments shown in FIGS. 21, 22, 23, 24, 25, 26, 27, 28, 29, 30, 31, 32, 33, 34, 35, 36, 37, 38, 39, 41 and 45 may be used with or without evidence material. Where evidence material is used, the devices described in FIGS. 21, 22, 23, 24, 25, 26, 27, 28, 29, 30, 31, 32, 33, 34, 35, 38, 39 and 45 would be enclosed in a larger easily breakable vessel capable of holding numerous such devices. Examples of such vessels are shown in FIGS. 1, 2, 2B, 3, 4, 5, 5B, 6, 7, 8, 9, 10, 11, 12, 13, 14, 15, 16, 17, 18, 19 and 20.

Figure 21:
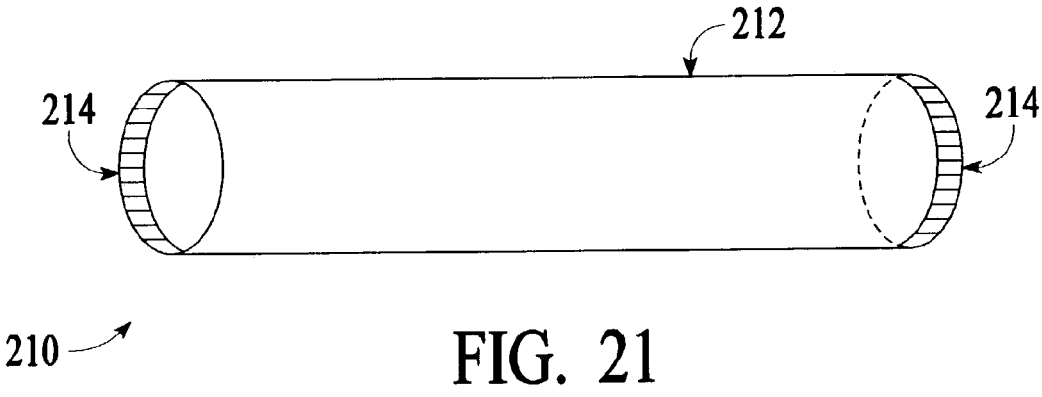
FIG. 21 is perspective view of tube tissue, skin, bone, hair and body fluids sampler and storage vessel

FIG. 21 shows a tube tissue, skin bone, hair and body fluids sampler and storage vessel 210 that includes tube body 212 and abrasive surfaces 214. Surfaces 214 are abrasive for purpose of removing tissue, skin, bone, body fluids and hair of the attacker and depositing it into tube body 212. Numerous tube vessels 210 would be contained in a large evidence material vessel and would rub against the attacker while struggling with the victim. The samples so deposited into tube vessel 210 would help apprehend the suspect through deoxyribonucleic acid (DNA) analysis or a similar analysis. Vessel 210 can be used with or without other evidence materials. Vessel 210 may be manufactured of any suitable material including metal, ceramic, plastic, stone and wood. The length of vessel 210 would typically be about 1 millimeter (mm).

Figure 22:
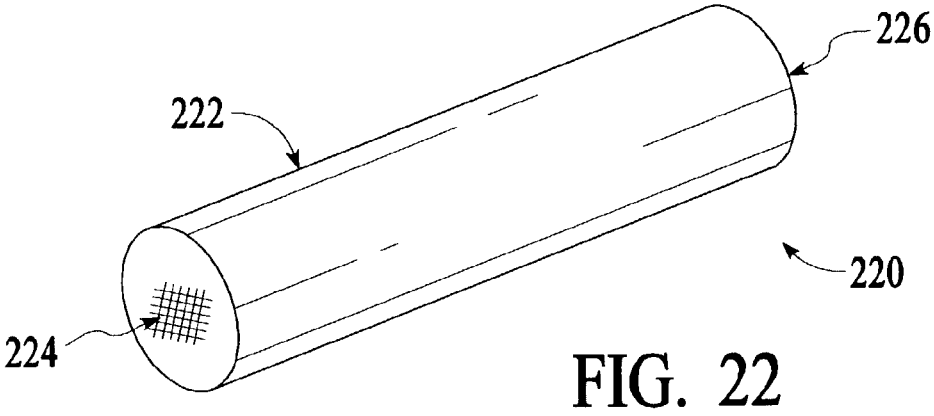
FIG. 22 is a front view of rod tissue, skin, bone, hair and body fluids sampler and storage vessel

Another embodiment of tissue, skin, bone, body fluid and hair sampler and storage vessel is shown in FIG. 22 in form of rod 220 that has rod body 222 and abrasive surfaces 224 and 226. The abrasive surfaces 224 and 226 are capable of removing tissue, skin, hair, body fluid or bone samples. The abrasive surfaces 224 and 226 include materials such as sandpaper, scotch-brite, grit, buffing material, scouring pad material, plastic and metal mesh, ceramic and metallic particles.

Numerous rod vessels 220 would be contained in a large evidence material vessel and would rub against the attacker while struggling with the victim. The tissue, skin, bone, body fluids and hair samples deposited onto rod vessel 220 would help apprehend the suspect through DNA or similar methods of identification. Vessel 220 may be manufactured of any suitable material including metal, ceramic, plastic, stone and wood and is typically about 1 mm in length.

Figure 23:
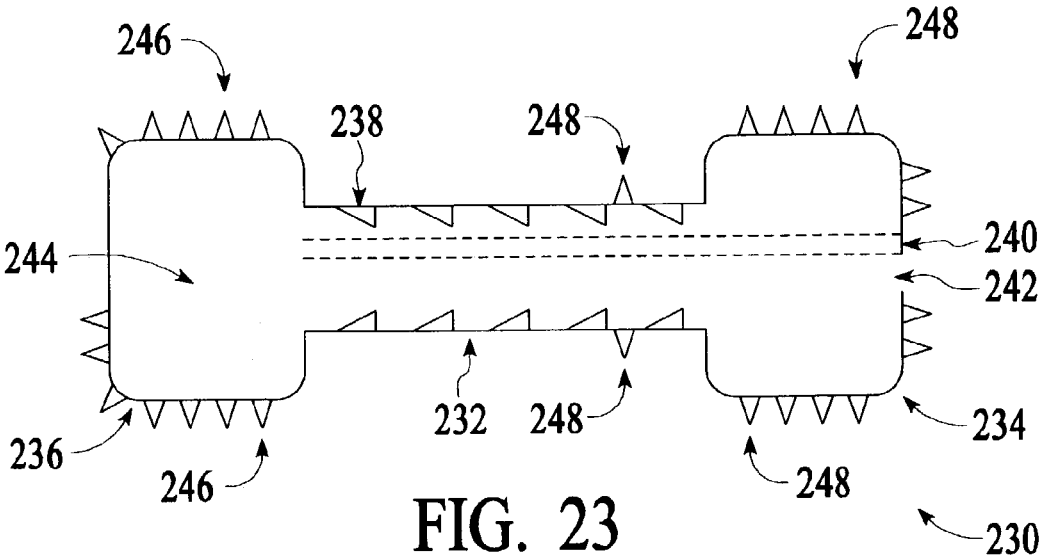
FIG. 23 is another embodiment of tube tissue, skin, bone, hair and body fluids sampler and storage vessel

FIG. 23 is another embodiment of tissue, skin, bone, body fluid and hair sampler and storage vessel 230 that has a tube 232 that optionally includes evidence material 244, skin rapier 234 that removes tissue, skin, bone, body fluid and hair samples when blades 248 are pressed against one's skin, skin scooper 236 that also removes tissue, skin, bone, body fluid and hair samples when pressed against one's skin with the aid of blades 246, scooper 236 channeling removed tissue, skin, bone, body fluid and hair samples into tube 232 and storing them in tube 232 and skin rapier 234 area of the device. Tube 232 with the aid of protruding projections 238 aimed in the direction opposite to the outflow of evidence material 244 from tube 232 retains collected samples. Tube 232 further includes evidence material bleed hole 240 and evidence material exit opening 242 through which evidence material flows out when more removed sample enters tube 232. Preferably, size of opening 242 is such that tube 232 retains most of samples collected. Presence of tissue, skin, bone, body fluid and hair samples of the victim and the attacker in tube 232 and externally will aid in identification of the abductor and his association with the child. Vessel 230 may be manufactured of any suitable material including metal, ceramic, plastic, stone and wood and is typically about 1 mm in length.

Figure 24:
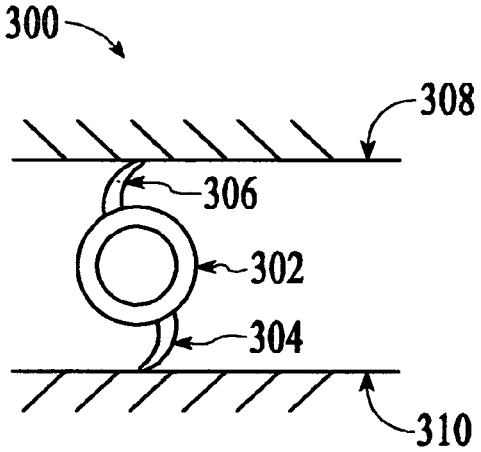
FIG. 24 is front view of blade attached to the tube vessel

Shown in FIG. 24 as item 300 is the cutting blade detail of FIG. 23. Blade 300 presses against the skin of a victim and an attacker. Blades 304 and 306 are attached to tube 302 and are preferably positioned approximately 180 degrees apart from each other. Shown also are respective skin surfaces of the victim 308 and the attacker 310. The blades 304 and 306 are pressed against skins 308 and 310 during the attack and remove some of the tissue, skin, bone, body fluid or hair samples of both parties.

Figure 25:
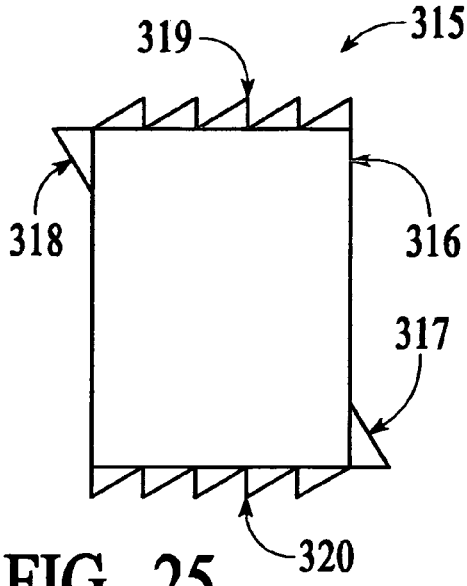
FIG. 25 is a front view of another embodiment of tube vessel with a blade and storage capability

FIG. 25 shows an embodiment of rod tissue, bone, skin, body fluid and hair sampler with body 316, blades 317 and 318 and end surfaces 319 and 320, end surfaces 319 and 320 having rough finish. Blades 317 and 318 would press against the persons' skins and remove and retain some tissue, skin, bone, body fluid or hair samples and store them on blades 317 and 318, end surfaces 319 and 320 and rod 316. Sampler 315 may be manufactured of any suitable material including metal, ceramic, plastic, stone and wood and is typically about 1 mm in length.

Figure 26:
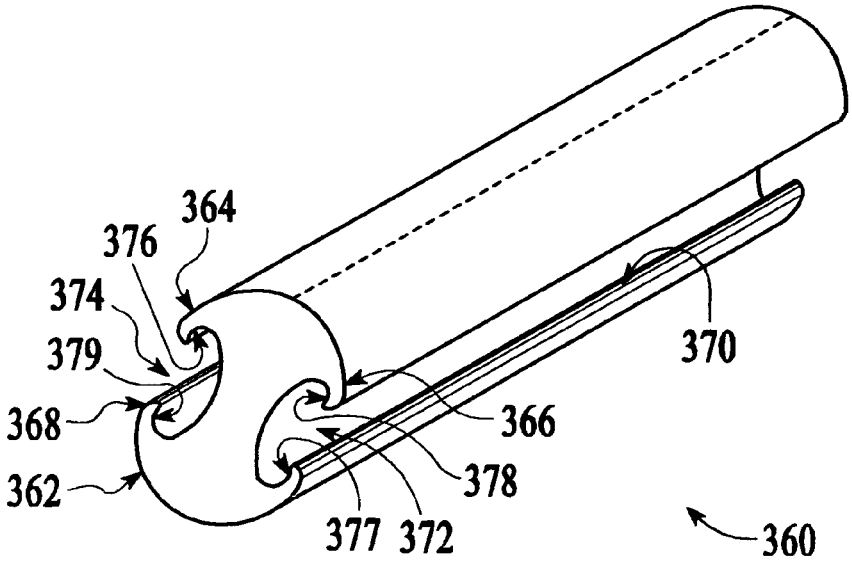
FIG. 26 is a panoramic view of simpler embodiment of tube vessel with blade and storage capability

Another embodiment of rod tissue, skin, bone, body fluid and hair sampler and storage vessel is shown by the panoramic view in FIG. 26 wherein the vessel 360 has rod 362 and cutting blades 364, 366, 368 and 370 that are preferably positioned about 180 degrees apart from each other, sample storage volumes 372 and 374 and protruding projections 376, 377, 378 and 379. Typically, blades 364, 366, 368 and 370 and projections 376, 377, 378 and 379 are extruded for cost control purposes, but they may also be machined. Blades 364, 366, 368 and 370 press against the body of an attacker and remove a sample, while protruding projections 376, 377, 378 and 379 help store and retain the samples. Vessel 360 may be manufactured of any suitable material including metal, ceramic, plastic, stone and wood and is typically about 1 mm in length.

Figure 27:
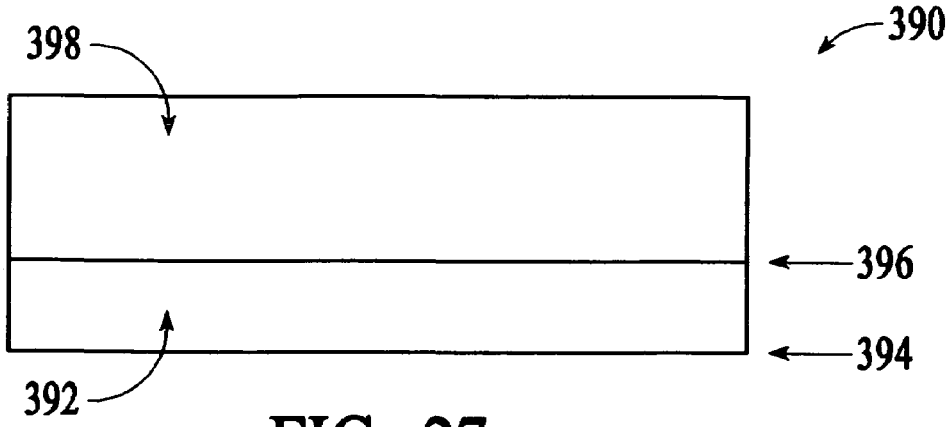
FIG. 27 is the front length-wise view of the simpler tube vessel of FIG. 26

Shown in FIG. 27 is a length-wise view of the device of FIG. 26 where the device 390 has rod portion 398, sharp edges 394 and 396, and sample storage space 392.

Figure 28:
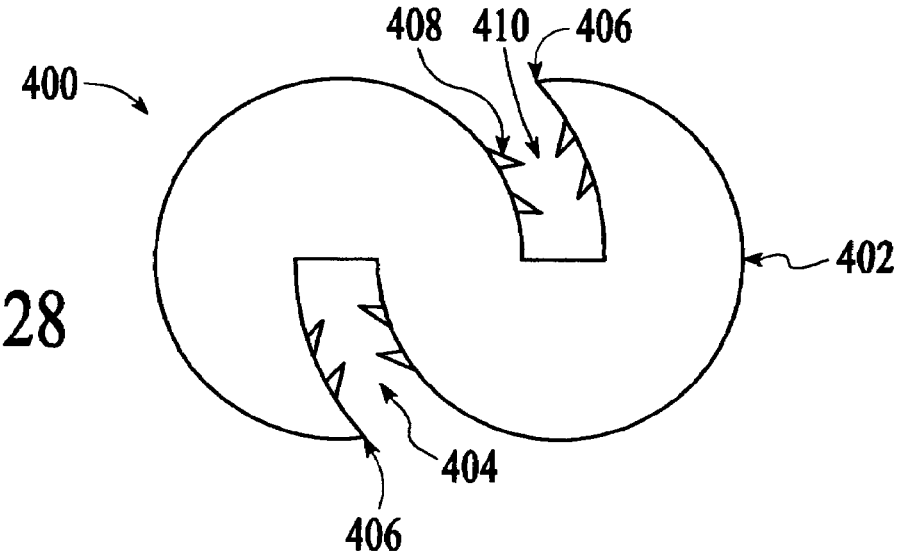
FIG. 28 is the front view of the blade and storage detail of FIG. 26

FIG. 28 shows another embodiment of tube tissue, skin, bone, body fluid and hair sampler and storage vessel 400, where 402 is tube body, sample storage spaces are 404 and 410, cutting blades are 406, and 408 are protruding projections. When pressed aginst the attacker's and the victim's skin, cutting blades 406 and 408 remove samples. Storage spaces 404 and 410 have been shaped as slots for better retention of the samples collected and protruding projections 408 positioned are included on both sides of storage space 404 and 410, and aimed in the direction opposite to the outflow of samples taken from storage space 404 and 410. Vessel 400 may be manufactured of any suitable material including metal, ceramic, plastic, stone and wood and is typically about 1 mm in length.

Figure 29:
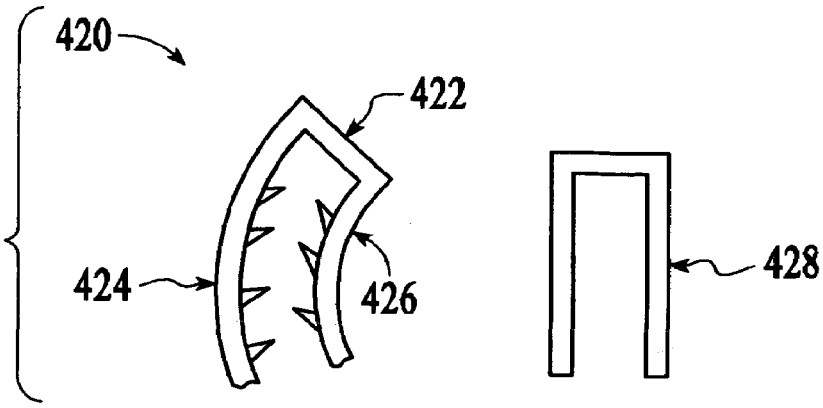
FIG. 29 is tube tissue, skin, bone, hair and body fluids sampler and storage vessel with angled storage slot

Shown in FIG. 29 is the sample storage space detail 420 (items 404 and 410 in FIG. 28) where the storage slot 422 having sharp projections 424 and 426 has been further angled away from the vertical storage space 428 position for better sample retention.

Figure 30:
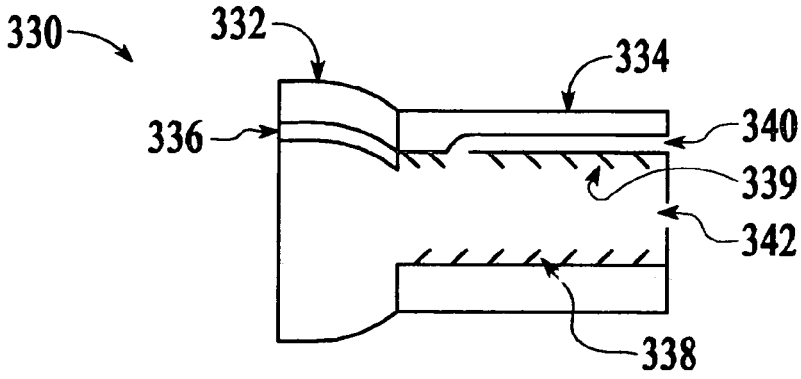
FIG. 30 is tube tissue, skin, bone, hair and body fluids sampler and storage vessel capable of sequencing the samples taken

FIG. 30 is a tissue, skin, bone, body fluid and hair sampler and storage vessel 330 that enables sequential taking of the attacker's and the victim's samples. Vessel 330 has scooper 332 that stuffs the samples into tube body 334, cutting blade 336 that removes the samples, protruding projections 338, evidence material bleed channel 340 and evidence material exit opening 342 that is preferably smaller than a typical sample taken. Projections 338 are directed opposite the outflow of evidence material from tube 334 to prevent escape of the samples taken. This embodiment makes it likely that the victim's and the attacker's skin samples will be taken alternatively and in similar quantities. Vessel 330 may be manufactured of any suitable material including metal, ceramic, plastic, stone and wood and is typically about 1 mm in length.

Figure 31:
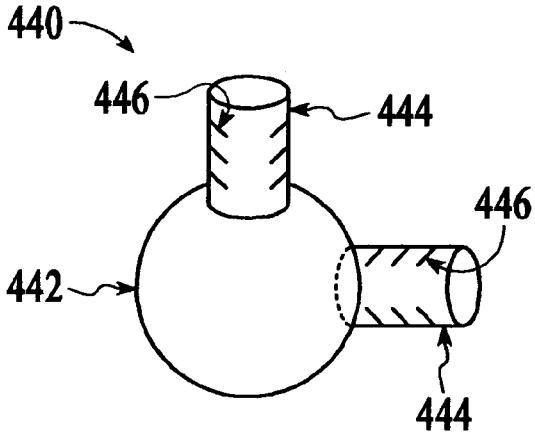
FIG. 31 is a vessel capable of holding a plurality of sampler and storage units

Shown in FIG. 31 is a holder 440 capable of holding a plurality of tube or rod tissue, skin, bone, body fluid and hair samplers and storage vessels. Holder 440 has holding body 442, tubes 444 and protruding projections 446 located within tubes 444, preferably in the direction opposite to outflow of the evidence material from tubes 444 so to prevent the outflow of tissue, skin, bone, body fluid and hair samples from tube 444. As the attacker grabs the victim the holder 440 is squeezed in between the two skin surfaces removing tissue, skin, bone, body fluid and hair samples and storing them inside tubes 444. Alternatively, tubes 444 can be replaced with rod samplers of FIG. 22 or FIG. 25.

Figure 32:
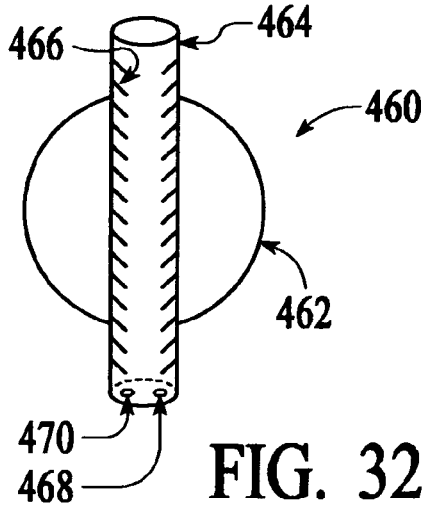
FIG. 32 is vessel of FIG. 31 with sampler extending through the device

FIG. 32 shows the holder 460 with holder body 462, tube 464 extending through body 462, protruding projections 466, evidence material exit opening 468 and evidence material bleed opening 470. Alternatively, tubes 464 can be replaced with rod samplers of FIG. 22 or FIG. 25.

Figure 33:
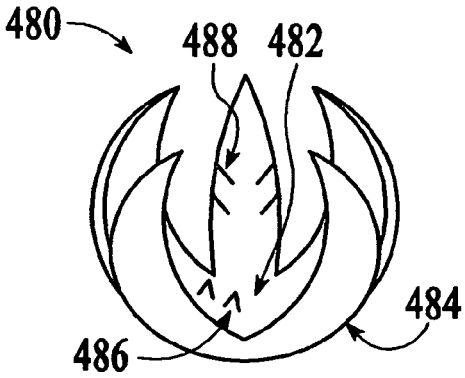
FIG. 33 is star shaped skin, tissue, bone, hair and body fluids sampler and storage vessel

FIG. 33 shows a star shaped tissue, skin, bone, body fluid and hair sampler and storage vessel 480 that includes vessel body 482, prongs 484, protruding projections 486 located in body 482 and protruding projections 488 located on prongs 484. Pressure exerted between the skin of the attacker and the victim would cause prongs 484 to remove tissue, skin, bone, body fluid and hair samples of both and retain them with projections 486, 488 and the entire vessel 480.

Figure 34:
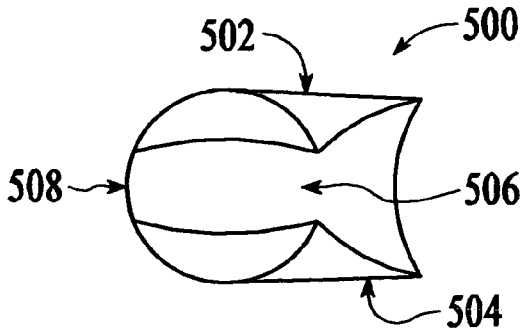
FIG. 34 is a panoramic view of hair sampler

An alternative to the tissue, skin, bone, body fluid and hair sampler embodiment is a hair sampler whose panoramic view is shown in FIG. 34. The hair sampler 500 has two surfaces 502 and 504 connected to each other at 508 and folded over until space 506 between them is of sufficient dimension to accommodate a sample of human hair.

Figure 35:
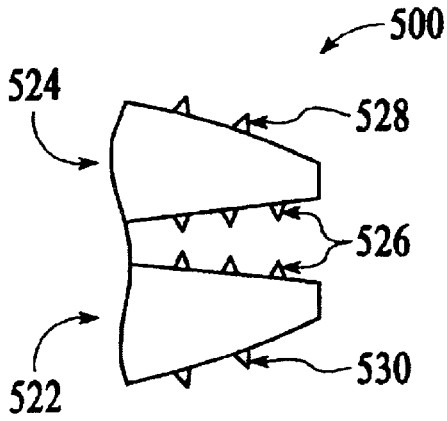
FIG. 35 is a side view of hair sampler

FIG. 35 shows the side view of sampler 520 having surfaces 522 and 524, sharp projections 526 located on inside surfaces of surfaces 522 and 524 and projections 528 and 530 located on outside surfaces of surfaces 524 and 522. It is not essential that surface 522 and 524 have projections 526, 528 and 530 so long as surfaces 522 and 524 are sufficiently abrasive to pull or cut human hair. Hair sampler 500 would rub against the victim's and the attackers skin or head hair pull out samples as a result of the pressure exerted during the struggle.

Figure 36:
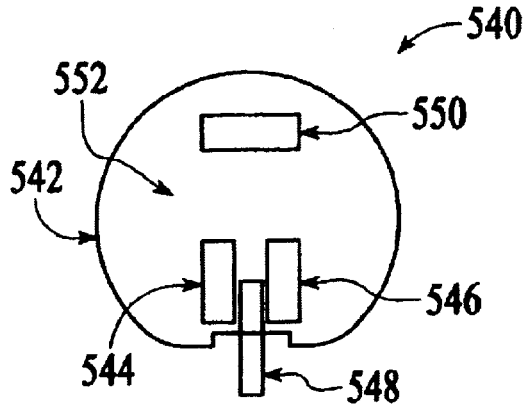
FIG. 36 is an audio warning system

FIG. 36 shows an audio warning system that may be employed with or without evidence material included therein. Audio warning system 540 may be a sphere or another object that is made of either rigid or resilient material. System 540 includes enclosure 542, audio source 550, electronics 544 for controlling source 550, a battery or solar power source 546, an insulator 548 and evidence material 552. When endangered, a victim would pull out the insulator 548, thus placing power source 546 in contact with electronics 544. Electronics 544 would then activate audio source 550 and a prerecorded message would be played. This message may include alarm, requests that police be called, siren, cries for help, a horn, a buzzer, a child's scream, a gun shot, shriek, dog growl, dog bark, and scream. If evidence substance is included, the victim would smear it onto the attacker's skin or it would reach the attacker during the struggle. A person skilled in the art will know how to seal and protect the electronics and the battery from evidence material. Any commercially available audio source, electronics and power source will suffice.

Figure 37:
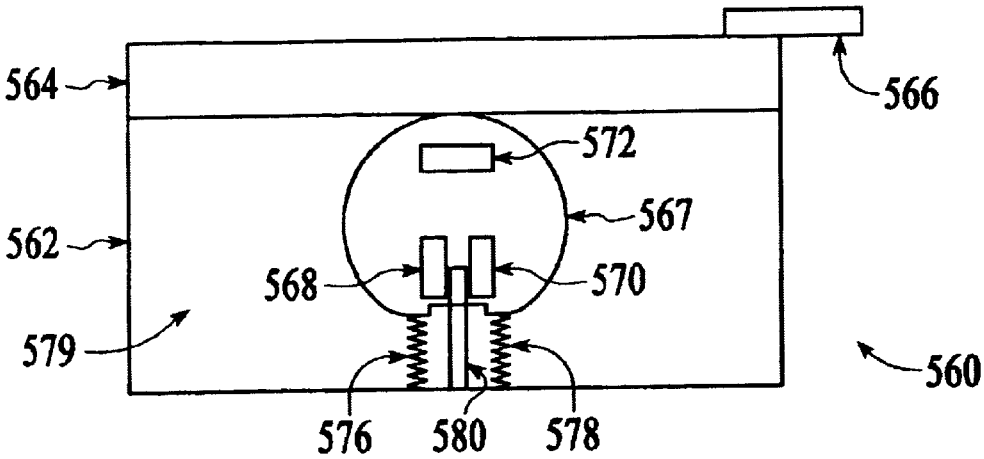
FIG. 37 is a spring activated audio warning device

Another embodiment of audio warning system capable of housing multiple audio warning systems is shown in FIG. 37 where system 560 has enclosure 562, the enclosure cover 564, the cover release latch 566, the audio source enclosure 567, the audio source 572, audio control electronics 568, the battery or solar power source 570, compressed springs 576 and 578 for supporting enclosure 567, evidence material 579 contained in enclosure 562 and insulator 580. When cover 564 is removed by pushing on it in horizontal direction or pulling on release latch 566, springs 576 and 578 push upward on enclosure 567. The spring action forces enclosure 567 from its position and ejects it from enclosure 562. This motion disengages enclosure 567 from insulator 580, thus bringing electronics 568 in contact with power source 570 and so activating audio source 572 that would play a prerecorded message. This message may include alarm, requests that police be called, siren, cries for help, a horn, a buzzer, a child's scream, a gun shot, shriek, dog growl, dog bark, and scream. The device 560 may be conveniently positioned on a shoulder for a quick release by hand or even mouth pull on latch 566. The device 560 may be used with or without evidence material 567.

Figure 38:
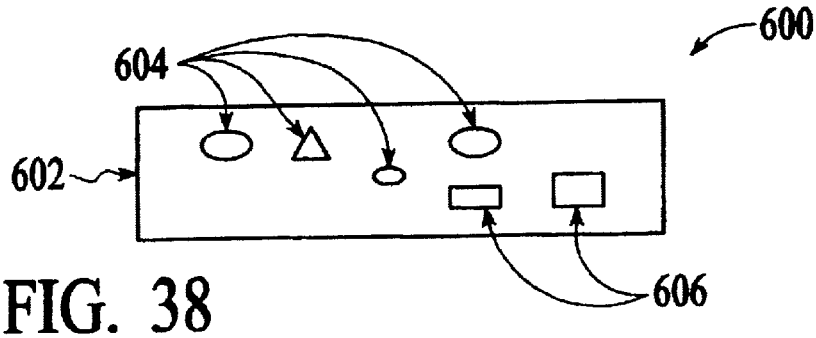
FIG. 38 is an identification marker device

Another approach to identifying and discouraging an attacker is shown in FIG. 38 where the evidence material applying device 600 has device body 602, and shapes 604 and 606 generated in body 602. Body 602 can be a ring, a wire, a plate, a string, a thread, an oblong object, an oval or round object or any geometric shape. Shapes 604 and 606 are generated by any manufacturing means. When device 600 is pressed between the attacker's and the victim's skin, the pattern on body 602 would transfer to the attacker together with any evidence material being employed and serve as an identification code.

Another embodiment of device 600 comprises use of ceramic pieces with their shape and composition making up the identification code. A further embodiment would employ ball bearings with patterns impressed in them. Generally, the identification code would be unique to the individual unit of the invention or to a certain number of units of the invention. The identification code can be implemented by means of composition of materials used, shape, or a combination thereof. Device 600 can be enclosed in large numbers in any easily breakable evidence material vessel.

Figure 39:
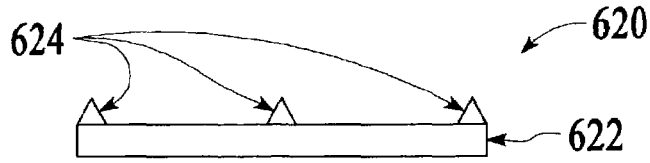
FIG. 39 is a tissue, skin, bone and hair sampler also capable of injecting chemical into the attacker

FIG. 39 shows another embodiment of applying evidence material and collecting tissue, skin, bone, body fluid and hair samples where device 620 has body 622 and sharp protrusions 624 emanating from body 622. The pressure exerted upon protrusions 624 during struggle would cause the marks to be made in the attacker's and the victim's skin, transfer evidence material onto the skins of both, and tissue, skin, bone, body fluid and hair samples onto device 620. The device 620 may be made of any suitable material and can be enclosed in large numbers in any easily breakable vessels with or without evidence material therein.

Figure 40:
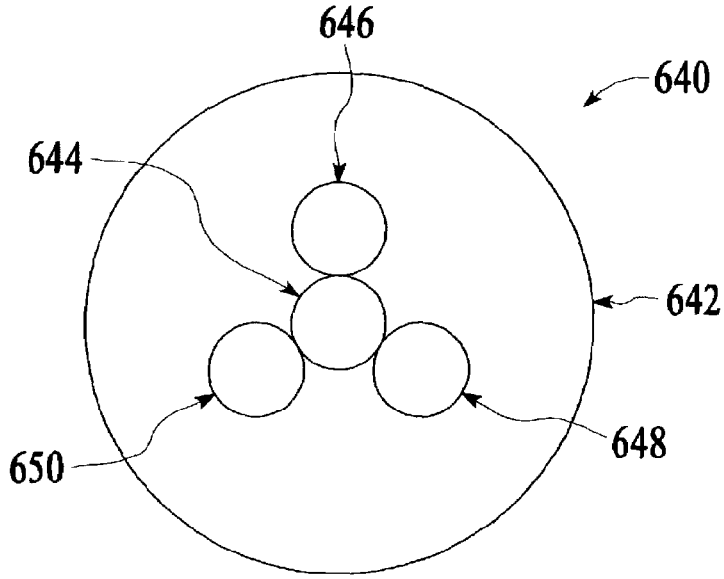
FIG. 40 is a light generating device

Shown in FIG. 40 is light generating device that can be employed to deter an attacker. Device 640 includes the outer shell 642, the mixing and leak detecting chamber 644, and light generating chemical storing chambers 646, 648 and 650. Any number of storing chambers may be employed according to how many chemicals are employed. Chamber 644 is clear and is employed to inspect for leaks from other chambers. The outer shell 640 is stronger than chambers 646, 648, and 650. This allows the user to break the walls of chambers 646, 648, and 650 by squeezing on shell 642 and allow for mixing of light generating chemicals in chamber 644 without compromising the integrity of outer shell 642. Alternatively, any commercially available light generating device may be employed.

Figure 41:
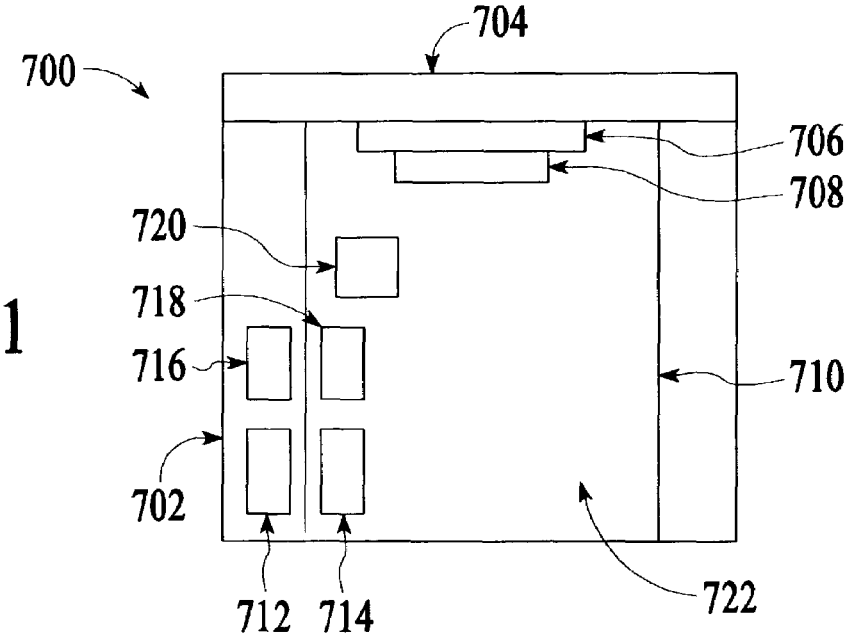
FIG. 41 is an audio device; tissue, skin, bone and hair sampler, a light source and a cutting tool.

FIG. 41 shows a device 700 that combines the vessel body 702, vessel cover 704, a shock absorber 706, a light source 708, a cutting tool 710, a power source 712, a light source 714, a power source 716, audio electronics 718, an audio source 720 and evidence material 722. When cover 704 is removed batteries 712 and 716 come in contact with light source 714 and audio electronics 718 respectively. The light source 716 lights up and audio source 720 plays a pre-recorded message as already described. Light source 708 is energized by motion or additional shaking if needed. Cutting tool 710 is available for the victim's escape if needed. Device 700 may be used with or without evidence material 722.

Figure 42:
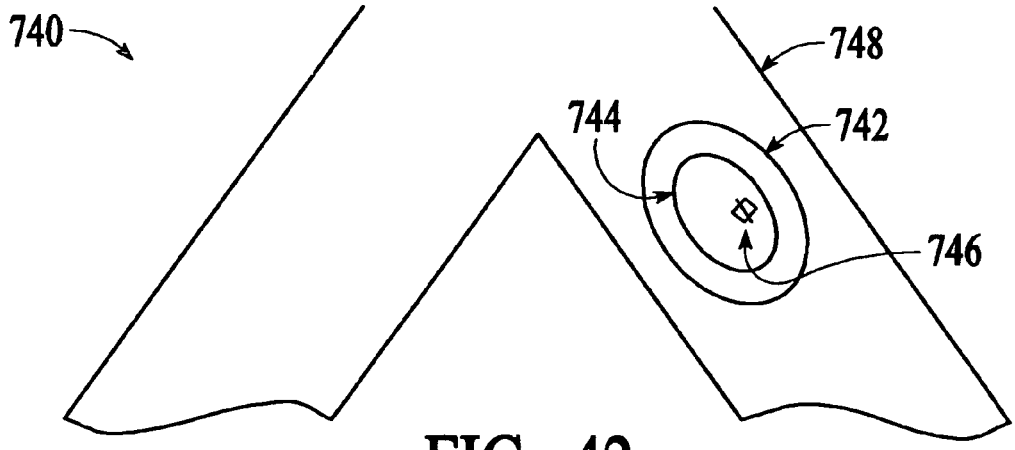
FIG. 42 is a clothing patch vessel

FIG. 42 shows a patch of clothing vessel, where vessel 740 is a piece of cloth 742 loosely attached onto a clothing item 748 and covering evidence material holder 744 and evidence material 746. Pulling off cloth 742 and pressing upon holder 744 exposes material 746 and allows it to be applied to or it just spreads onto the victim and the attacker. Vessel 740 can be similarly concealed on one's shoes, head cover or similar items.

Figure 43:
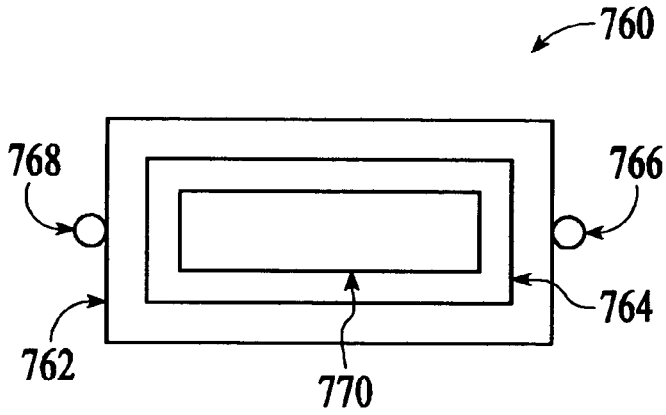
FIG. 43 is a health alert warning vessel

FIG. 43 is top view of health alert vessel 760 that may be worn on a necklace of FIG. 13 or a bracelet or a wrist band of FIG. 2. Vessel 760 includes a plate 762, evidence material enclosure 764, attachment devices 766 and 768 for connecting vessel 760 to a necklace, a bracelet or a wrist band, and lettering 770 indicating health alert condition. Holding device 760 between fingers and applying pressure on lettering 770 will cause evidence material to escape enclosure 764 and spread onto the victim and the attacker.

Figure 44:
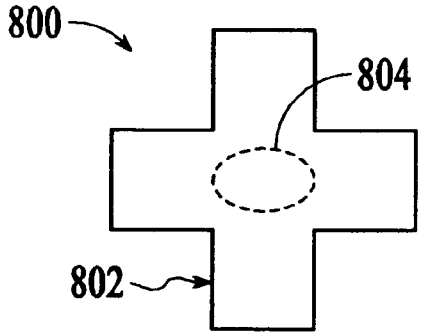
FIG. 44 is a red cross vessel

FIG. 44 is a red cross vessel 800 that has the cross 802 in red color, and evidence material enclosure 804, enclosure 804 preferably located at the back of cross 802. Applying pressure to both sided of cross 802 in the enclosure 804 area will cause evidence material to escape enclosure 804 and spread onto the victim and the attacker.

Figure 45:
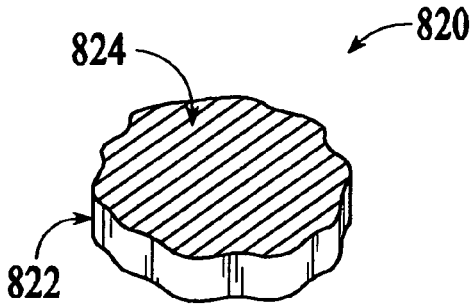
FIG. 45 is a scouring pad vessel

FIG. 45 is scouring pad vessel 820 commonly used in cleaning soiled surfaces. Vessel 820 has pad 822 comprised of numerous threads 824. Threads 824 are abrasive enough to remove a sample of tissue, skin, bone, body fluid or hair and store it on and amongst threads 824. Vessel 820 will be used in any one of the enclosures described herein with or without evidence material.

Figure 46:
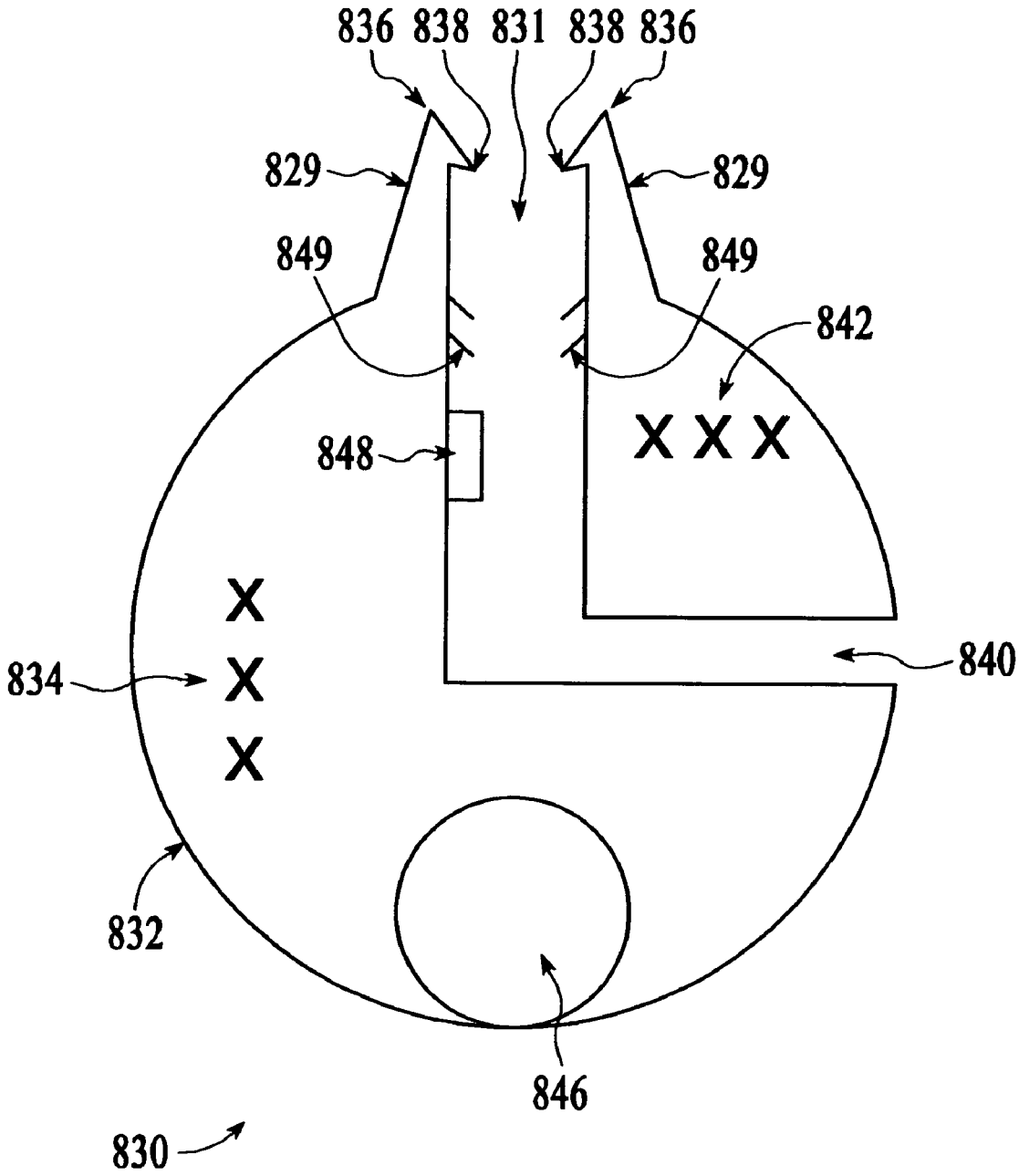
FIG. 46 is a rounded shape object with an identity code and an identification device

FIG. 46 shows circularly shaped tool 830 for obtaining and storing tissue, skin, bone, body fluid or hair samples. Tool 830 has round body 832, cavity 831 for storing tissue, skin, bone, body fluid or hair samples, sample obtaining sections 829 extending outwardly from the tool surface and terminating in sharp points 836 an 838, protruding projections 849, air bleed channel 840, an identification code 834, a radio frequency device 842, an audio alert or light alert or combination thereof 846 and a preservative 848. In its most basic embodiment tool 830 is positioned between the skin of a victim and the attacker. In the course of interaction between the two individuals some portion of the skins of each person would be removed by action of sharp points 836 and 838 of the sample obtaining portion 829 and directed into the cavity 831. The channel 840 allows for air to escape in order to enable easier sample entry. Rounded shape of device 830 would allow it to roll between the victim and the attacker and take the samples sequentially, thus storing both in the cavity 831 and increasing the capability to positively connect the attacker to the victim. To preserve the properties of stored samples, a preservative 848 may be added. The preservative 848 may be salt solution such as dry brine or similar. Addition of an audio or light alarm 846, or combination of both would direct additional attention to the attacker and the victim. The surface of tool 832 may also be textured as in the area 834 for better sample collection and it may contain a unique identification code or a radio frequency identification device 842. To assure greater retention and minimize sample outflow, protruding projections 849 may be positioned in cavity 831.

Figure 47:
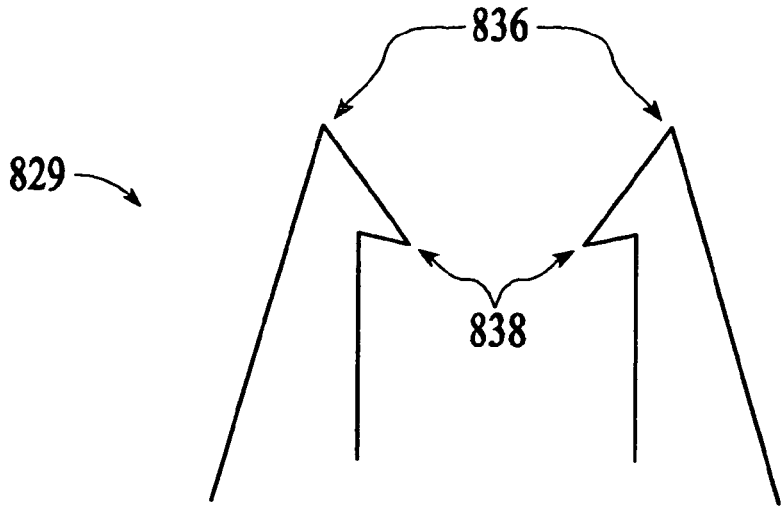
FIG. 47 is the detail of the sample removal portion of FIG. 46

FIG. 47 shows the detail of the sample collection area with edges 836 and 838 being sharp to assure greater skin penetration and therefore better sample collection.

Figure 48:
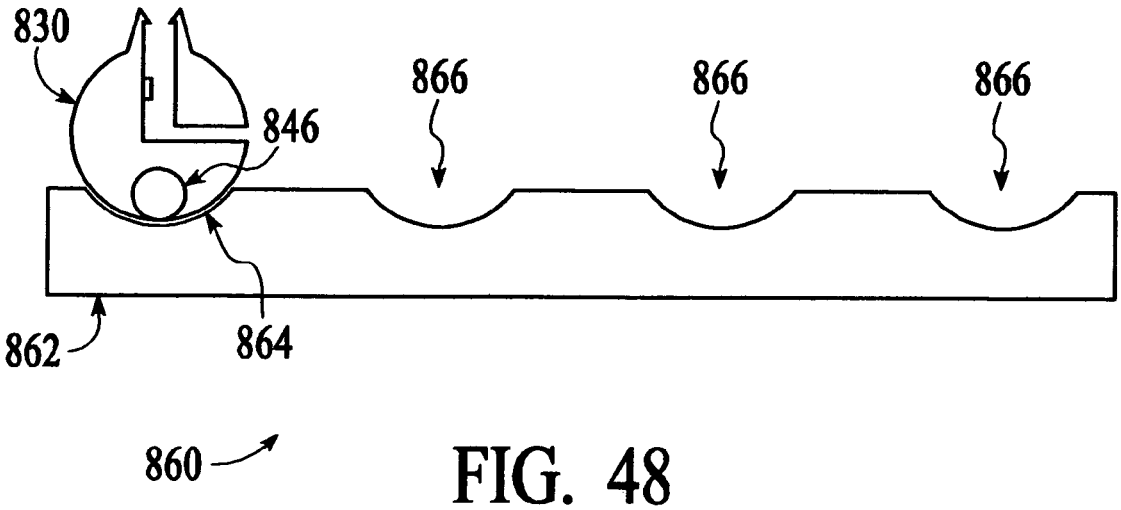
FIG. 48 is a holder with positions for multiple sampler and storage devices

FIG. 48 shows the device 860 housing device 830 on holder 862 in spaces 866. Attachment may be accomplished by any suitable means. Removal of device 830 activates audio and or light alert 864. Some devices 830 may be equipped with the alert 864 and some may not be so equipped. Also, some of the spaces 866 may be left unpopulated by devices 830. This would cause the attacker to search for the missing devices 830 and delay his escape. Device 830 may employ different coloring scheme in order to further confuse the attacker.

Figure 49:
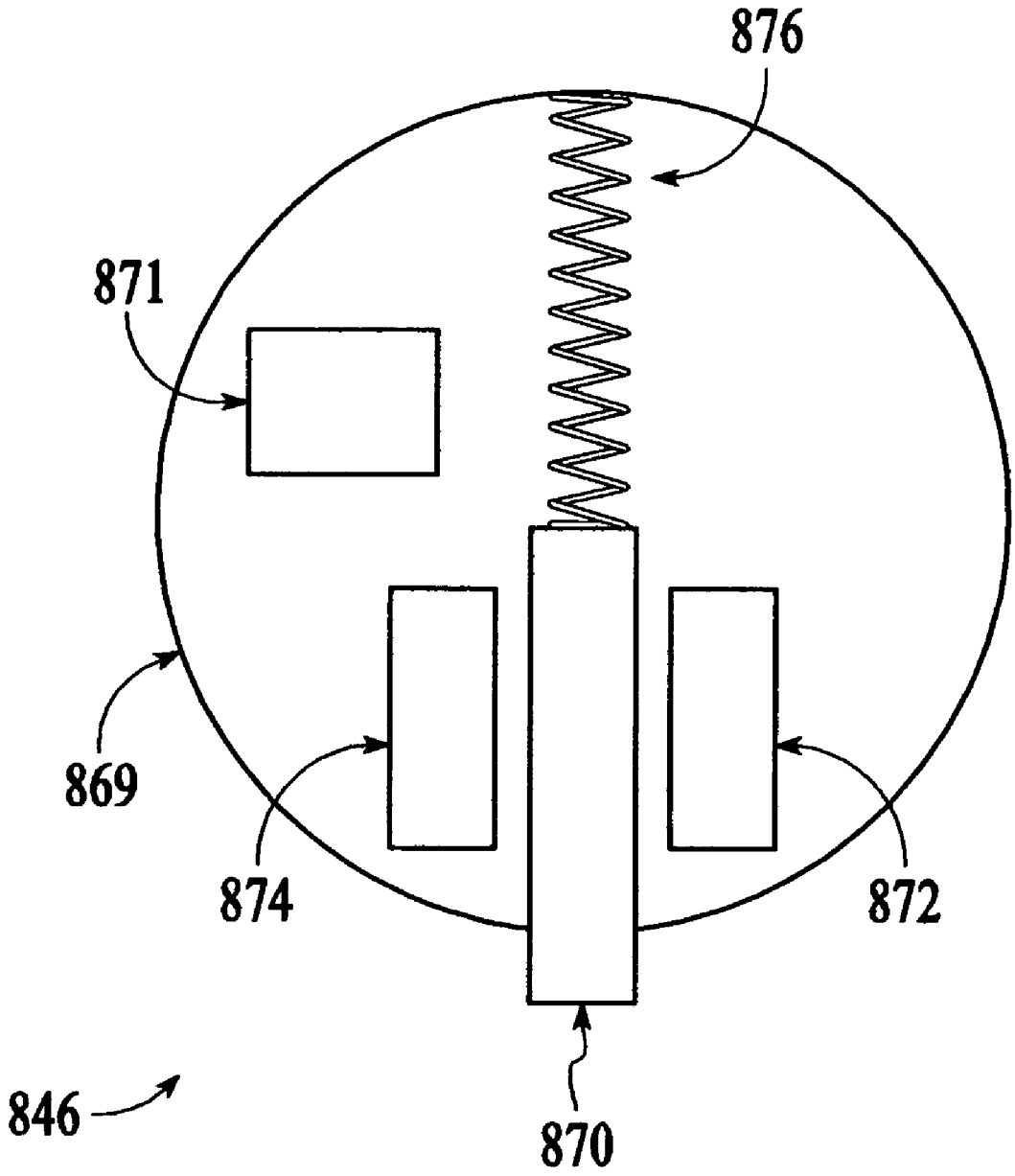
FIG. 49 is an alarm device that activates when removed from its position

FIG. 49 shows the audio and or light alert device 846. Removal of device 846 from its position in the holder 862 causes the compressed spring 876 to release and force out the insulator 870. This action brings the power source 874 in contact with electronics 872 which in turn activate audio and or light alert device 871.

Figure 50:
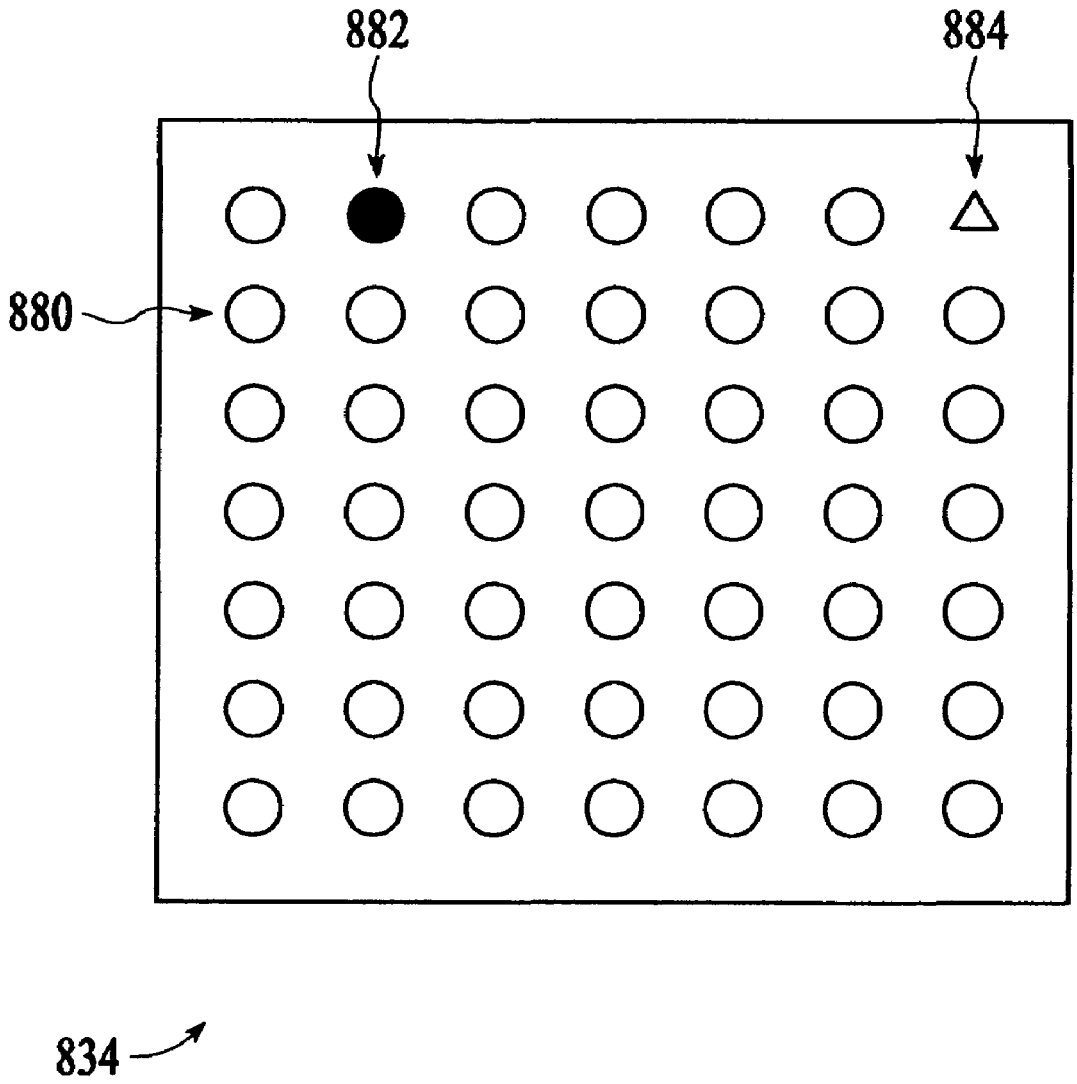
FIG. 50 is a matrix of possible identity codes

FIG. 50 shows an arrangement of different types of identity codes 880, 882 and 864 that may be placed upon various devices described in this specification, such as the device 830. In this case of a 7 by 7 matrix 582 billion unique codes are possible. Other arrangements are of course also possible.

Figure 51:
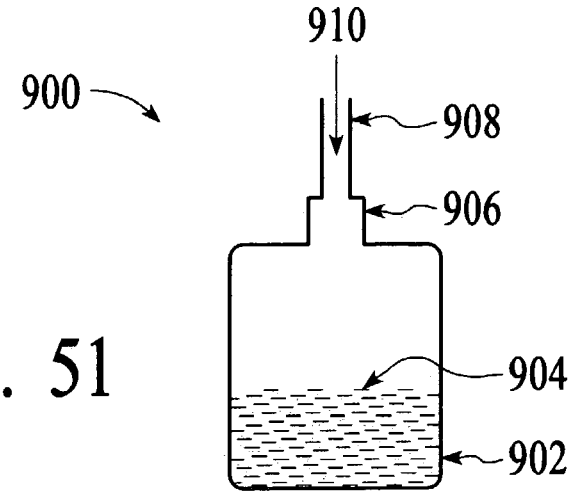
FIG. 51 is a vessel requiring pressure to release evidence material

FIG. 51 is a vessel 900 showing the container 902 housing evidence material 904. Container 902 further has a narrowed neck-like extension 906 terminating in an elongated portion 908 that is narrower than section 906. Pressing on walls of container 902 forces the evidence material 904 out through the opening 910 and onto the attacker. This would discourage the attacker and simplify his capture and identification.

Figure 52:
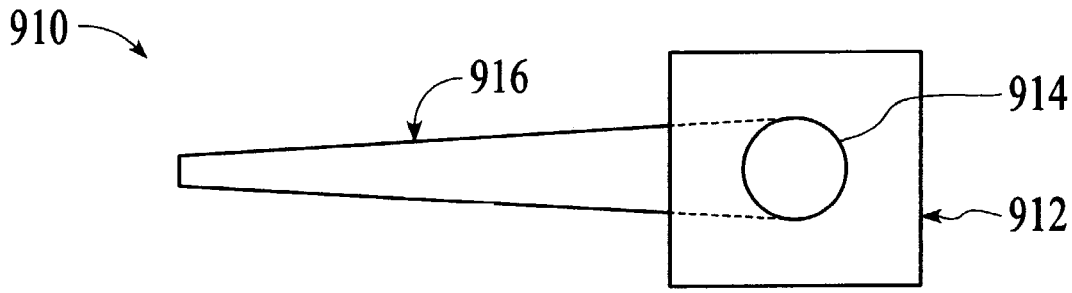
FIG. 52 is a device with a spool and a ribbon

FIG. 52 is a signal for help type of device 910. It includes the body of the device 912, spool 914 and a length of material 916 wrapped around the spool 914. The material may be a string, wire, ribbon, rope, cord or a combination of these or other materials. Its main purpose is to call the attention after a person has been abducted. Typically, the device 910 is used in a moving vehicle, the motion of which enables the material 916 to unwind and extend well beyond the vehicle itself. The material 916 is preferably very bright or very reflective, making it far more visible to others. Additionally, words of distress or other attention capturing displays may be employed. To increase the chances of being seen, some segments of the material may be made weaker than the other. This would cause them to break off, and if spotted by another person would increase the chances of the event being reported to authorities.

Figure 53:
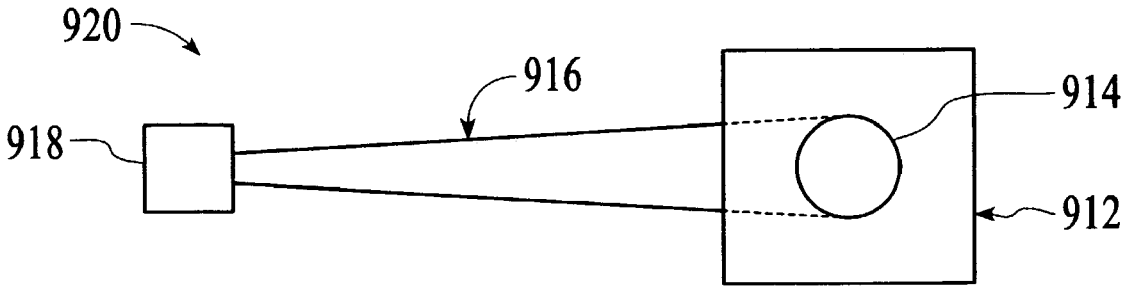
FIG. 53 is a device with a spool, ribbon and an object attached thereto

Another embodiment of this device is shown in FIG. 53 where the device 920 has an object 918 attached at or near the end of ribbon 916. This would enable the ribbon 916 to be less subject to the wind generated by the motion of the vehicle and stretch out in more or less straight line. Preferably, the object 918 is a ound generating device, such as a whistle. Air motion through the object 918 would cause it to produce sound, further increasing chances of being noticed by others.

Figure 54:
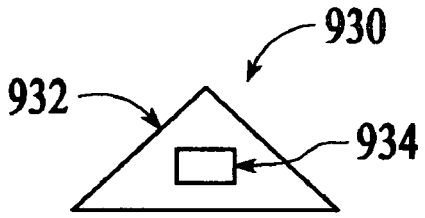
FIG. 54 is a penetrating device with an identification code

FIG. 54 is a front view of the skin penetrating device 930 that may be contained in any of the vessels described in this specification or it may be a stand alone device. The device usually has triangular shape 932 with sharp vertices to enable easy skin penetration. The device 930 preferably includes an identity code 934 described previously in this specification. Presence of a unique identity code would make it easier to identify the attacker.

Figure 55:
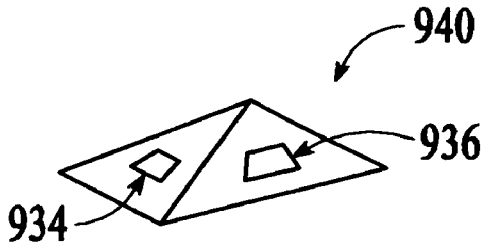
FIG. 55 is a penetrating device with an identification code and a radio frequency device

Another embodiment of the skin penetrating device is shown in FIG. 55 where the device 940 also has a radio frequency identification device 936 in addition to the identity code 934. Presence of radio frequency identification device 936 makes it possible to detect the presence of the attacker or the victim whenever they pass through a proper electromagnetic field. The identity of the device 936 is then communicated to the host computer for processing and enabling easier location of the attacker and the victim.

The radio frequency identification device 936 may also be employed on any of the tools for taking samples of skin, tissue, bone, body fluids or hair as described in this specification, in any of the vessels containing evidence materials or in evidence materials themselves. The device 936 may be electrically active or electrically inactive. Active radio frequency identification device is powered by an internal battery which enables it to have greater read range, thus enabling an easier detection of a person with such device on them. Electrically inactive devices do not have their own power source but operate from the power generated by the read device. This gives them essentially unlimited life, however, they do suffer from short read range, making it more difficult to detect a victim or the attacker with such device on them.

Figure 56:
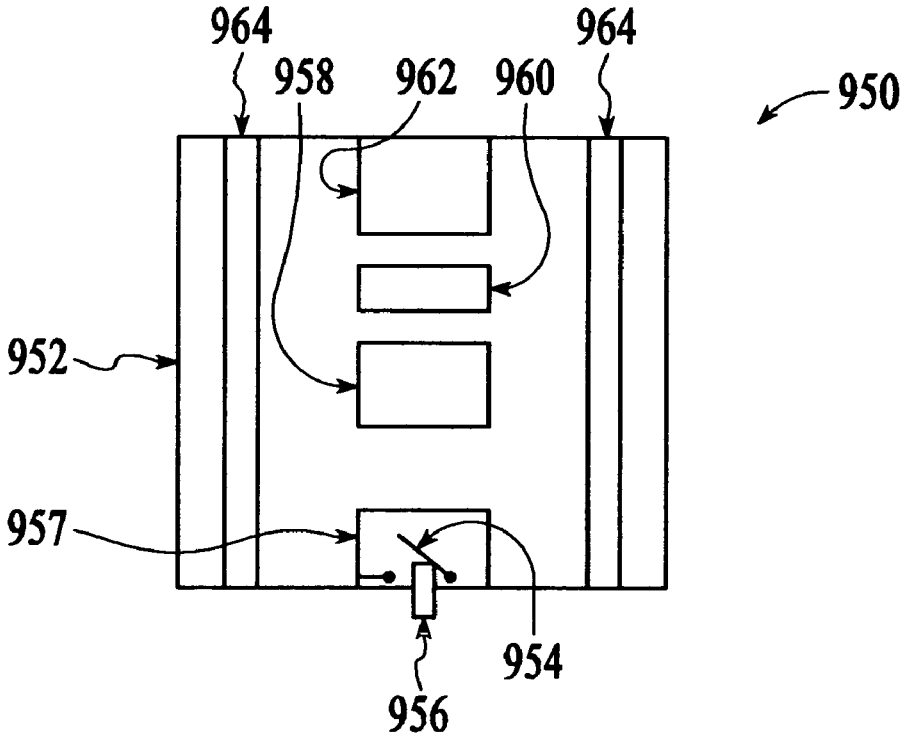
FIG. 56 is a front view of a combination sampler device, audio and light alert

FIG. 56 shows front view of device 950 that has body 952 combining a tool for obtaining and retaining skin, bone, tissue, hair or body fluids 964 with power supply 957, power switch 954, insulator 956, drive electronics 958, light alert 960 and an audio source 962. Removal of insulator 956 causes the power switch to close contact and connect power supply 958 to electronics 958 that control light source 960 and audio source 962, thus calling attention to the victim and the attacker. Of course, the device 952 may be employed of itself without the audio and light sources.

Figure 57:
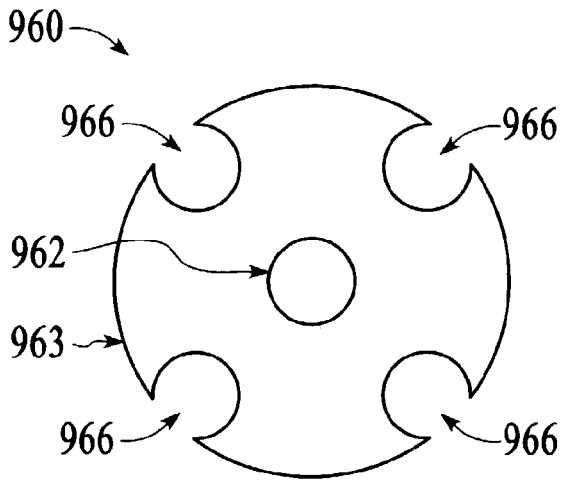
FIG. 57 is a top view of device in FIG. 56

FIG. 57 is the top view of device 952 of rod or tubular shape 963 and showing the sections 966 for storing removed skin, bone, tissue, hair or body fluid samples and audio alert device 962. The samples are removed as a result of the motion of device 952 between the victim and the attacker.

Figure 57B:
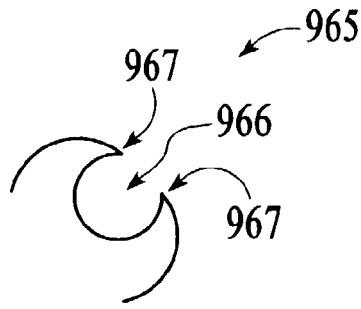

FIG. 57B shows the detail of section 965 employed to remove the samples. The sharp points 967 penetrate into the skin and remove samples thereof and direct them into the section 966. The retained samples are then used to help identify the attacker and the victim.

Figure 58:
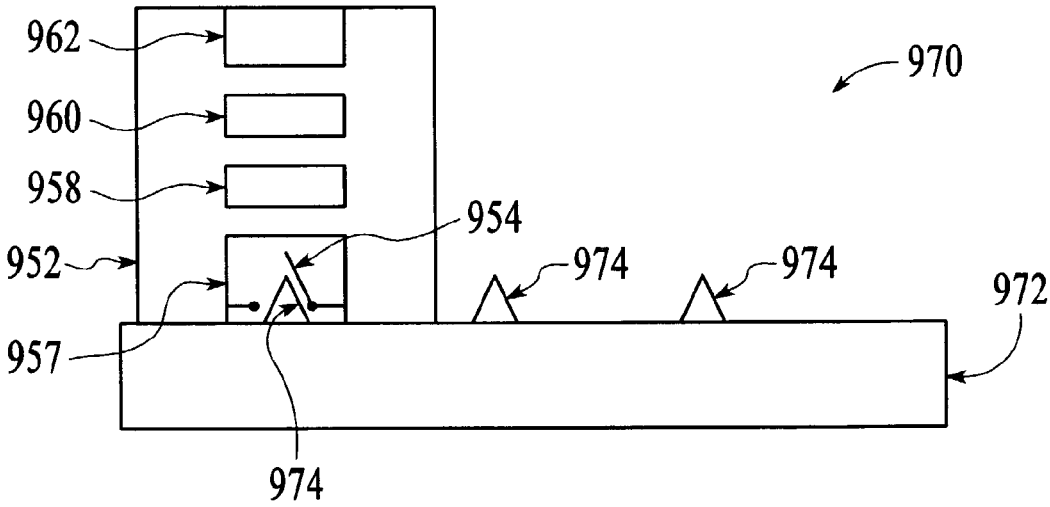
FIG. 58 is a holding device for housing multiple devices of FIG. 56

FIG. 58 is a device 970 that employees a holder 972 populated by at least one device 952. Removal of device 952 from projection 974 allows the switch 954 to close and connect power supply 957 to electronics 958 that control light source 960 and audio source 962, thus calling attention to the victim and the attacker.

An attacker may also be deterred, captured or identified by applying a layer of adhesive to a vessel containing evidence material, the adhesive being stronger than the breaking strength of the vessel. Pulling on the vessel causes the vessel to break and release the evidence material upon the victim and the attacker.

Alternatively, vessel containing evidence material may be attached to a person by a connector that is stronger that the breaking strength of the device. Attempt to remove the device would cause it to break and spread evidence material on the victim and the attacker.

In another approach, several vessels may be connected by a materials stronger than the breaking strength of the device and placed on a person. Pulling onto the connecting material would break at least one vessel and spread the evidence material onto the attacker and the victim.

Although the present invention has been described in considerable detail, other variations are possible. Therefore, the spirit and the scope of the claims should not be limited to the description of the version contained herein.

What is claimed is:

1. A device comprising: a band, a wrist band, a bandage, a bracelet, a rod, a skin scab, scouring pad, a finger cot, a patch of clothing, health condition alert device, a red cross, adhesive enhanced vessel, jewelry, an earring, a watch, a ring, a necklace, a pin, a tie, a pen, belt buckle, a badge, an arm band, a toe ring, an ankle ring, a wrapper, a bag, and a vessel shaped as: a birthmark, a skin mark, a skin scab, a skin rash or human skin; said device further comprising individually or in combination thereof: thymophthalein and ethanol mix, iodine, perylene, anthracene, ink, foam as produced by dishwashing soap, pine tar, orange chalk powder, bromine gas, lemon oiled water, coffee oil, coconut oil, pineapple extract, aloe, commercially available jelly, mineral oil, commercially available hand cleaners, scotch-brite, steel wool, fiber-optic segments, automotive oil, alcohol, base, oil, grease, automotive grease, epoxy, glue, silicon cement, tissue abrading material, scouring pad, absorbent material, plastic mesh, metallic mesh, peppermint oil, spearmint oil, water, sprit glum, mixture of heterocyclic compound lumino and hydrogen peroxide, an inert material, lemon oiled water, water with fish-line segments or similar materials, fiber-optic cable segments, metal, ceramic, plastic, glass or wood; dishwashing soap, phosphorus, silicon glue, glitter particles same in size and shape or combination of sizes and shapes, segments of wire, segments of material with unique patterns created therein string, radioactive material, polonium, sprit glum adhesive, silicon glue, epoxy resin formed by polymerization of bisphenol and epichlorohydrin, deoxyribonucleic acid, human immunodeficiency virus, small pocks virus, urushiol, functional semiconductor devices doped with phosphorus and conductors attached thereto, henna, poison oak, poison ivy, alcohol, base, dry blood or blood encased in a container, bromine gas, water and cesium that burst upon contact, mercury, mix of pentobarbital and sodium pentothal, epoxy resin, epoxy resin formed by polymerization of bisphenol A and epichlorohydrin of varying compositional ratios, fluorescing blue color produced by perylene when exposed to black light, fluorescing ultra-violet color produced by anthracene when exposed to black light, oleoresin capsium, acid, commercially available light sources, and a mix containing 4 grams sodium carbonate, 0.2 grams luminol, 0.5 grams ammonium carbonate and 0.4 grams of copper pentahydrate and 1 liter of water, 50 milliliters of 3% hydrogen peroxide and 1 liter of water.

2. A device comprising a tube body having first end and second end, the first end defining first surface and the second end defining second surface, the tube body further comprising an inner surface and an outer surface, a rod body having first end and second end, the first end defining first surface and second end defining second surface, an object round in shape and defining a cavity and comprising an outer surface, a tool with an arcuate space, a holding device, an object shaped as a star with inward folded ends and comprising an inner surface and an outer surface, and a folded-over device comprising an abrasive, inner surface and an outer surface.

3. The device of claim 2 further comprising individually or in combination thereof:

thymophthalein and ethanol mix, iodine, perylene, anthracene, ink, foam as produced by dishwashing soap, pine tar, orange chalk powder, bromine gas, lemon oiled water, coffee oil, coconut oil, pineapple extract, aloe, commercially available jelly, mineral oil, commercially available hand cleaners, scotch-brite, steel wool, fiber-optic segments, automotive oil, alcohol, base, oil, grease, automotive grease, epoxy, glue, silicon cement, tissue abrading material, scouring pad, absorbent material, plastic mesh, metallic mesh, peppermint oil, spearmint oil, water, sprit glum, mixture of heterocyclic compound lumino and hydrogen peroxide, an inert material, lemon oiled water, water with fish-line segments or similar materials, fiber-optic cable segments, metal, ceramic, plastic, glass or wood; dishwashing soap, phosphorus, silicon glue, glitter particles same in size and shape or combination of sizes and shapes, segments of wire, segments of material with unique patterns created therein, string, radioactive material, polonium, sprit glum adhesive, silicon glue, epoxy resin formed by polymerization of bisphenol and epichlorohydrin, deoxyribonucleic acid, human immunodeficiency virus, small pocks virus, urushiol, functional semiconductor devices doped with phosphorus and conductors attached thereto, henna, poison oak, poison ivy, alcohol, base, dry blood or blood encased in a container, bromine gas, water and cesium that burst upon contact, mercury, mix of pentobarbital and sodium pentothal, epoxy resin, epoxy resin formed by polymerization of bisphenol A and epichlorohydrin of varying compositional ratios, fluorescing blue color produced by perylene when exposed to black light, fluorescing ultra-violet color produced by anthracene when exposed to black light, oleoresin capsium, acid, commercially available light sources, and a mix containing 4 grams sodium carbonate, 0.2 grams luminol, 0.5 grams ammonium carbonate and 0.4 grams of copper pentahydrate and 1 liter of water, 50 milliliters of 3% hydrogen peroxide and 1 liter of water.

4. The device of claim 2 further comprising a tissue, skin, hair, body fluid, and bone storage section.

5. The device of claim 2 further comprising projections anchored in its inner surface or cavity and pointing away from the surface and at an angle of no more than 90 degrees to the surface and in the direction opposite to the outflow of evidence material from the device.

6. A method for deterring an attack and aiding in identification of an attacker comprising the steps of:

manufacturing a vessel capable of housing evidence material;

placing the evidence material into the vessel;

applying a layer of adhesive to the vessel, the attachment strength of the adhesive exceeding the breaking strength of the vessel;

attaching the vessel containing the evidence material to the person to be protected;

removing the vessel from the person to be protected and thereby breaking the and releasing the evidence material; and spreading the evidence material over the person to be protected and the attacker.

* * * * *